US011702862B2

(12) United States Patent
Walls et al.

(10) Patent No.: US 11,702,862 B2
(45) **Date of Patent: *Jul. 18, 2023**

(54) MODULAR LOCK PLUG

(71) Applicant: Schlage Lock Company LLC, Carmel, IN (US)

(72) Inventors: Brian E. Walls, Colorado Springs, CO (US); Jason C. Clifford, Colorado Springs, CO (US); Scott D. Welsby, Colorado Springs, CO (US)

(73) Assignee: Schlage Lock Company LLC, Carmel, IN (US)

( * ) Notice: Subject to any disclaimer, the term of this patent is extended or adjusted under 35 U.S.C. 154(b) by 333 days.

This patent is subject to a terminal disclaimer.

(21) Appl. No.: 16/996,463

(22) Filed: Aug. 18, 2020

(65) Prior Publication Data

US 2021/0172200 A1 Jun. 10, 2021

Related U.S. Application Data

(63) Continuation of application No. 15/991,280, filed on May 29, 2018, now Pat. No. 10,745,937, which is a (Continued)

(51) Int. Cl.
*E05B 27/00* (2006.01)
*E05B 13/10* (2006.01)
(Continued)

(52) U.S. Cl.
CPC ..... *E05B 27/0082* (2013.01); *E05B 13/108* (2013.01); *E05B 19/0064* (2013.01);
(Continued)

(58) Field of Classification Search
CPC ..... E05B 9/04; E05B 9/048; E05B 13/108; E05B 19/0064; E05B 27/001;
(Continued)

(56) References Cited

U.S. PATENT DOCUMENTS 1,965,336 A 7/1934 Gerald
1,965,889 A 7/1934 Gerald
(Continued)

FOREIGN PATENT DOCUMENTS

CH 660619 A5 5/1987
DE 3817494 A1 11/1989
(Continued)

OTHER PUBLICATIONS

International Center for Patent Registration (United Arab Emirates); Search Report; UAE Patent Application No. P943/2016; 4 pages.
(Continued)

*Primary Examiner* — Christopher J Boswell
(74) *Attorney, Agent, or Firm* — Taft Stettinius & Holliser LLP

(57) ABSTRACT

A plug assembly including a plug, a sidebar movably mounted on the plug, and a plurality of rack pins seated in the plug. The sidebar is biased to an outer position in which the sidebar extends beyond an outer surface of the plug. Each rack pin includes a key-following leg and a sidebar-engaging leg. The sidebar-engaging leg includes at least one true gate. When a true gate of each rack pin is aligned with the sidebar, the sidebar is free to move radially inward to an inner position.

23 Claims, 18 Drawing Sheets

Related U.S. Application Data continuation of application No. 15/257,181, filed on Sep. 6, 2016, now Pat. No. 10,024,079, which is a continuation of application No. 14/633,072, filed on Feb. 26, 2015, now Pat. No. 9,435,138, which is a continuation-in-part of application No. 14/194,546, filed on Feb. 28, 2014, now Pat. No. 9,598,880.

(51) Int. Cl.
*E05B 63/00* (2006.01)
*E05B 19/00* (2006.01)
*E05B 29/00* (2006.01)

(52) U.S. Cl.
CPC ..... *E05B 27/005* (2013.01); *E05B 27/0017* (2013.01); *E05B 27/0057* (2013.01); *E05B 63/0056* (2013.01); *E05B 27/0078* (2013.01); *E05B 29/0066* (2013.01); *Y10T 70/7531* (2015.04); *Y10T 70/7616* (2015.04)

(58) Field of Classification Search
CPC ..... E05B 27/0017; E05B 27/005; E05B 27/0057; E05B 27/0078; E05B 27/0082; E05B 29/004; E05B 29/0066; E05B 63/0056
See application file for complete search history.

(56) References Cited

U.S. PATENT DOCUMENTS 2,024,441 A 12/1935 Gerald
2,139,842 A 12/1938 Miller
2,426,104 A 8/1947 Johnstone
2,460,551 A 2/1949 Swanson
2,629,247 A 2/1953 Deutsch
2,660,876 A 12/1953 Spain
2,808,717 A 10/1957 Jacobi
2,879,658 A 3/1959 Johnstone
2,949,762 A 8/1960 Johnstone
2,977,786 A 4/1961 Kendrick et al.
3,080,744 A 3/1963 Spain
3,264,852 A 8/1966 Gysin
3,298,211 A * 1/1967 Russell ..... E05B 9/084 70/369
3,410,123 A 11/1968 Jacobi
3,455,130 A 7/1969 Basseches
3,499,303 A 3/1970 Spain
3,597,948 A 8/1971 Johnstone
3,709,006 A 1/1973 Seidewand
3,722,240 A 3/1973 Spain et al.
4,393,673 A 7/1983 Widen
4,478,061 A 10/1984 Preddey
4,484,462 A 11/1984 Berkowitz
4,485,648 A 12/1984 Rabinow
RE31,910 E * 6/1985 Oliver ..... E05B 27/0039 70/494
4,750,342 A 6/1988 Nakai
4,977,767 A 12/1990 Prunbauer
5,067,335 A 11/1991 Widen
5,375,444 A 12/1994 Smith
5,540,071 A 7/1996 Reikher
5,582,050 A 12/1996 Haggstrom
5,640,865 A 6/1997 Widen
5,813,260 A * 9/1998 Widen ..... E05B 9/086 70/369
5,826,451 A 10/1998 Cook
6,029,484 A 2/2000 Jetton
6,079,240 A 6/2000 Shvarts
6,301,942 B1 10/2001 Shvarts
6,427,506 B1 8/2002 Prunbauer
6,477,876 B1 11/2002 Kim
6,481,255 B2 11/2002 Theriault et al.
6,708,539 B1 * 3/2004 Widen ..... E05B 9/04 70/369
6,959,569 B2 11/2005 Strader et al.
6,969,569 B2 11/2005 Montgomery et al.
6,981,396 B1 1/2006 Kim
7,308,811 B2 12/2007 Armstrong et al.
7,370,502 B2 5/2008 Widen
7,448,239 B1 11/2008 Huang et al.
7,584,635 B2 9/2009 Gan et al.
7,647,798 B1 1/2010 Jones et al.
7,810,365 B2 10/2010 Villani
7,900,491 B2 3/2011 Chong
7,963,135 B1 6/2011 Tobias et al.
3,056,380 A1 11/2011 Widen
8,117,876 B2 2/2012 Mathachan
8,186,194 B2 * 5/2012 Field ..... E05B 27/0035 70/495
8,621,902 B2 1/2014 Mathachan
8,656,747 B2 2/2014 Armstrong et al.
9,051,760 B2 6/2015 Herrmann
9,422,744 B2 * 8/2016 Lin ..... E05B 29/0033
9,435,138 B2 9/2016 Walls et al.
9,598,880 B2 3/2017 Walls et al.
10,024,079 B2 7/2018 Walls et al.
10,745,937 B2 * 8/2020 Walls ..... E05B 19/0064
11,274,468 B2 * 3/2022 Nye ..... E05B 27/005
2002/0056301 A1 5/2002 Theriault et al.
2004/0060331 A1 4/2004 Armstrong et al.
2005/0011242 A1 1/2005 Armstrong et al.
2005/0103073 A1 5/2005 Armstrong et al.
2005/0217330 A1 10/2005 Chong et al.
2006/0236733 A1 10/2006 Walter
2008/0163657 A1 7/2008 Dickhans et al.
2008/0314102 A1 12/2008 Gan et al.
2009/0241620 A1 10/2009 Field et al.
2010/0037666 A1 2/2010 Chong
2010/0326150 A1 12/2010 Chung
2011/0259065 A1 10/2011 Rao et al.
2012/0073340 A1 3/2012 Widen
2012/0240646 A1 9/2012 Herrmann
2013/0086958 A1 4/2013 Emory
2014/0069156 A1 3/2014 Romero et al.
2015/0211256 A1 7/2015 Field et al.
2016/0032618 A1 2/2016 Field et al.

FOREIGN PATENT DOCUMENTS

EP 0237172 A2 9/1987
EP 2055870 A1 5/2009
WO 2003062570 A1 7/2003

OTHER PUBLICATIONS

International Center for Patent Registration (United Arab Emirates); Examination Report; UAE Patent Application No. P943/2016; 4 pages.
Australian Patent Examination Report No. 1; Australia Patent Office; Australian Patent Application No. 2015222853; Nov. 11, 2016; 3 pages.
Canadian Office Action; Canadian Intellectual Property Office; Canadian Patent Application No. 2,943,811; Aug. 25, 2017; 6 pages.
Supplementary European Search Report; European Patent Office; European Patent Application No. 15754644.1; Nov. 7, 2017; 11 pages.
Chinese Search Report; State Intellectual Property Office; Peoples Republic of China; Chinese Patent Application No. 201580021202.7; Apr. 9, 2016; 6 pages.
Chinese Office Action; State Intellectual Property Office; Peoples Republic of China; Chinese Patent Application No. 201580021202.7; Apr. 18, 2018; 23 pages.
International Search Report and Written Opinion; International Searching Authority/US; International PCT Application No. PCT/US15/18052; dated Jun. 8, 2015; 8 pages.
Mexican Office Action; Mexican Patent Office; Mexican Patent Application No. MX/a/2016/011076; Oct. 30, 2019; 6 pages.
European Examination Report; European Patent Office; European Patent Application No. 15754644.1; May 6, 2019; 5 pages.
Korean Notice of Preliminary Rejection; Korean Intellectual Prop-

(56) References Cited

OTHER PUBLICATIONS erty Office; Korean Patent Application No. 10-2016-026725; May 31, 2018; 13 pages.

* cited by examiner

MODULAR LOCK PLUG

CROSS-REFERENCE TO RELATED APPLICATIONS

The present application is a continuation of U.S. patent application Ser. No. 15/991,280 filed on May 29, 2018 and issued as U.S. Pat. No. 10,745,937, which is a continuation of U.S. patent application Ser. No. 15/257,181 filed on Sep. 6, 2016 and issued as U.S. Pat. No. 10,024,079, which is a continuation of U.S. patent application Ser. No. 14/633,072 filed on Feb. 26, 2015 and issued as U.S. Pat. No. 9,435,138, which is a continuation-in-part of U.S. patent application Ser. No. 14/194,546 filed on Feb. 28, 2014 and issued as U.S. Pat. No. 9,598,880, the contents of each application are hereby incorporated herein by reference in their entirety.

TECHNICAL FIELD

The present disclosure generally relates to locks, and more particularly but not exclusively relates to locks including modular plugs.

BACKGROUND

Lock cylinders occasionally include locking sidebars which selectively prevent rotation of a plug with respect to a shell. Certain conventional locks of this type suffer from a variety of limitations. Therefore, a need remains for further improvements in this technological field.

SUMMARY

In one form, a plug assembly includes a plug, a sidebar movably mounted on the plug, and a plurality of rack pins seated in the plug. The sidebar is biased to an outer position in which the sidebar extends beyond an outer surface of the plug. Each rack pin is a single-piece unitary structure including a key-following leg and a sidebar-engaging leg. The sidebar-engaging leg includes at least one true gate and a plurality of false gates. When a true gate of each rack pin is aligned with the sidebar, the sidebar is free to move radially inward to an inner position. Further embodiments, forms, features, and aspects of the present application shall become apparent from the description and figures provided herewith.

DETAILED DESCRIPTION OF ILLUSTRATIVE EMBODIMENTS

Figure 1:
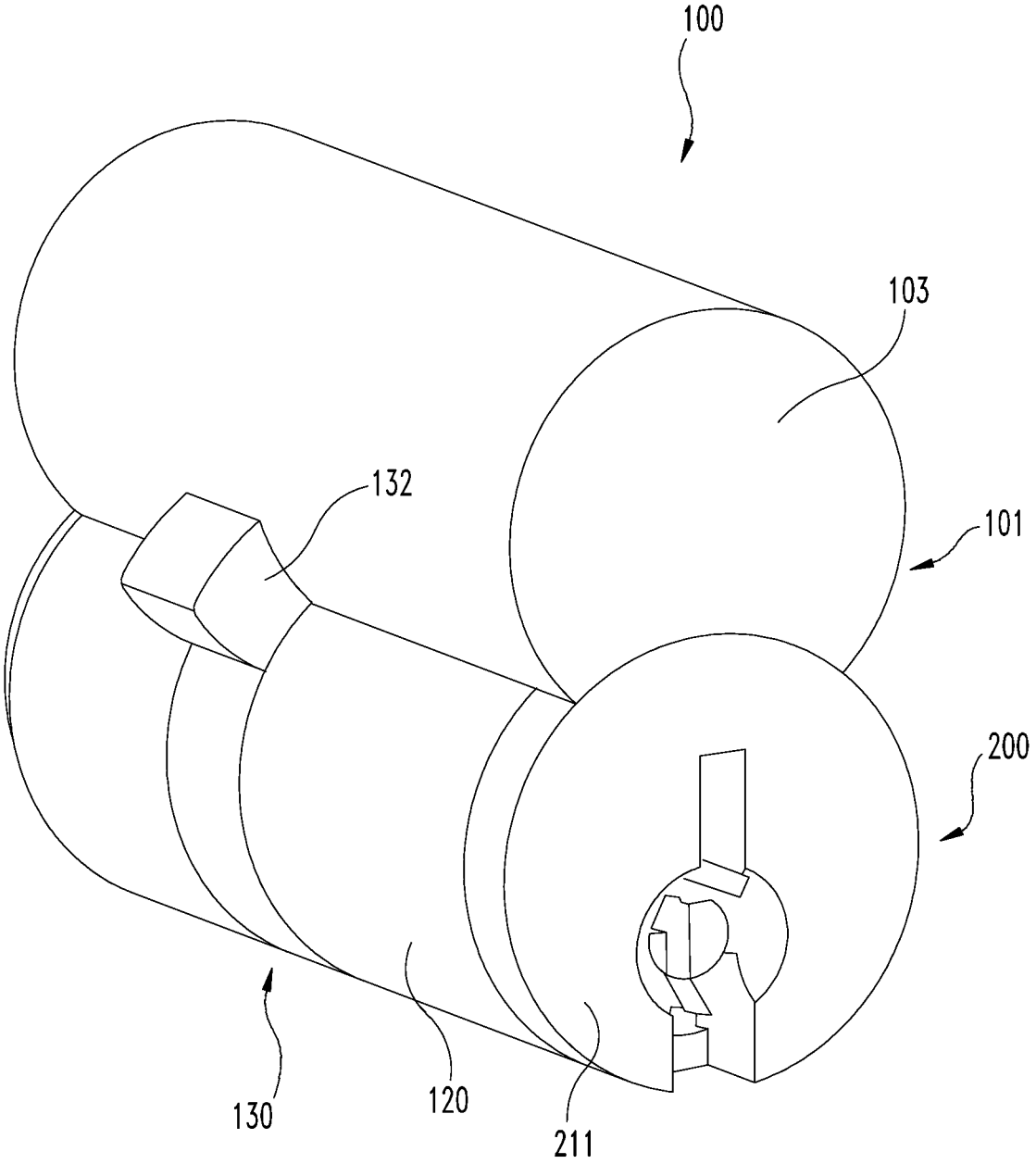
FIG. 1 is a perspective illustration of a lock cylinder according to an embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

As used herein, the terms "longitudinal", "lateral" and "transverse" are used to denote motion or spacing along or substantially along three mutually perpendicular axes. In the coordinate plane illustrated in FIG. 7, the X-axis defines the longitudinal directions (including a proximal direction and a distal direction), the Y-axis defines the lateral directions, and the Z-axis defines the transverse directions. These terms are used for ease of convenience and description, and are without regard to the particular orientation of the system with respect to the environment. For example, descriptions that reference a longitudinal direction may be equally applicable to a vertical direction, a horizontal direction, or an off-axis orientation with respect to the environment. Additionally, motion or spacing along one direction need not preclude motion or spacing along another of the directions. For example, elements which are described as being "laterally offset" from one another may also be offset in the longitudinal and/or transverse directions, or may be aligned in the longitudinal and/or transverse directions. The terms are therefore not to be construed as limiting the scope of the subject matter described herein.

With reference to FIG. 1, an illustrative lock cylinder 100 includes a shell 101 and a plug assembly 200. The shell 101 includes a shell body 120, and the shell 101 may further include a tower 103 configured to allow the cylinder 100 to be installed into an existing lock cylinder housing. In the illustrated embodiment, the tower 103 is configured such that the lock cylinder 100 can be installed into a small format interchangeable core (SFIC) housing. However, it is also contemplated that the shell 101 may have another configuration such as, for example, full size, mortise, rim, or key-in-knob/lever, or the shell 101 may alternatively be towerless.

Figure 2:
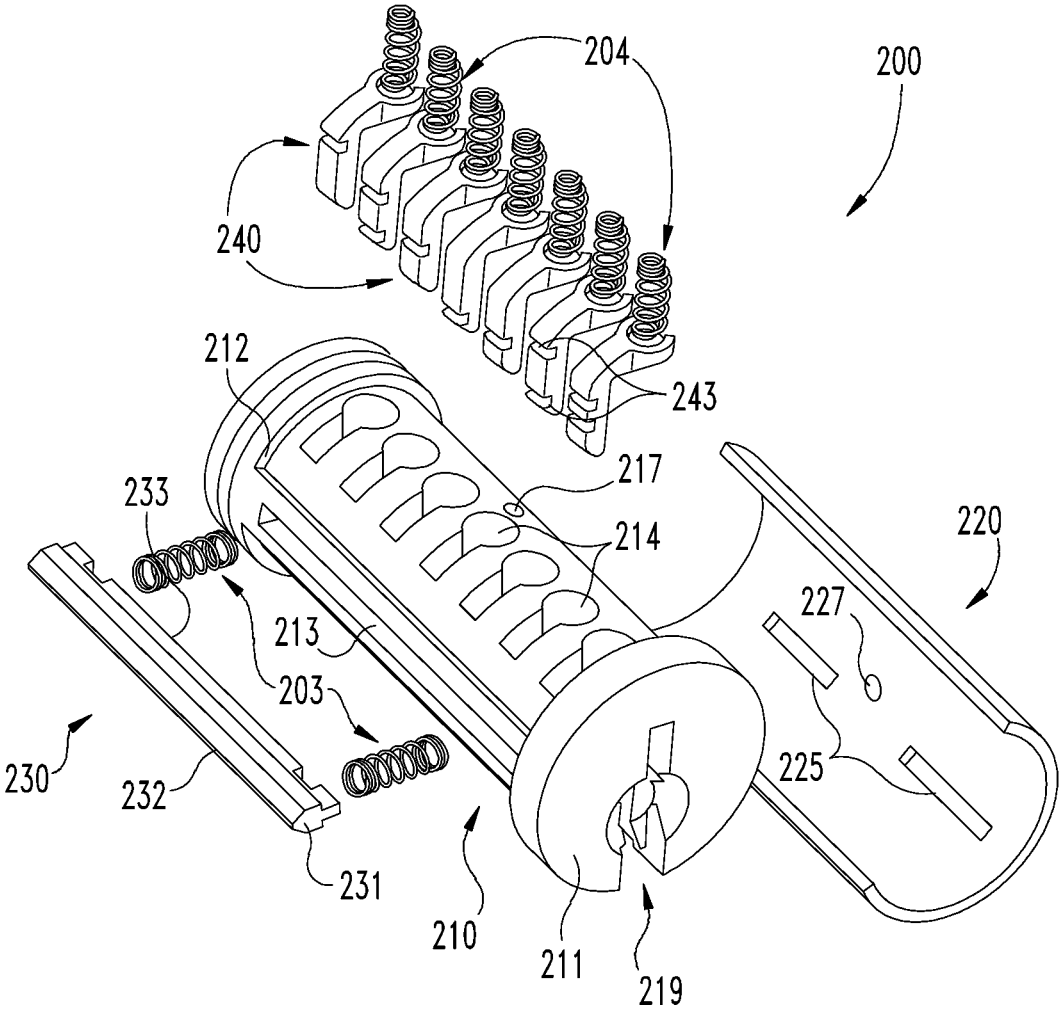
FIG. 2 is an exploded view of the lock plug used in the lock cylinder of FIG. 1.
Figure 3:
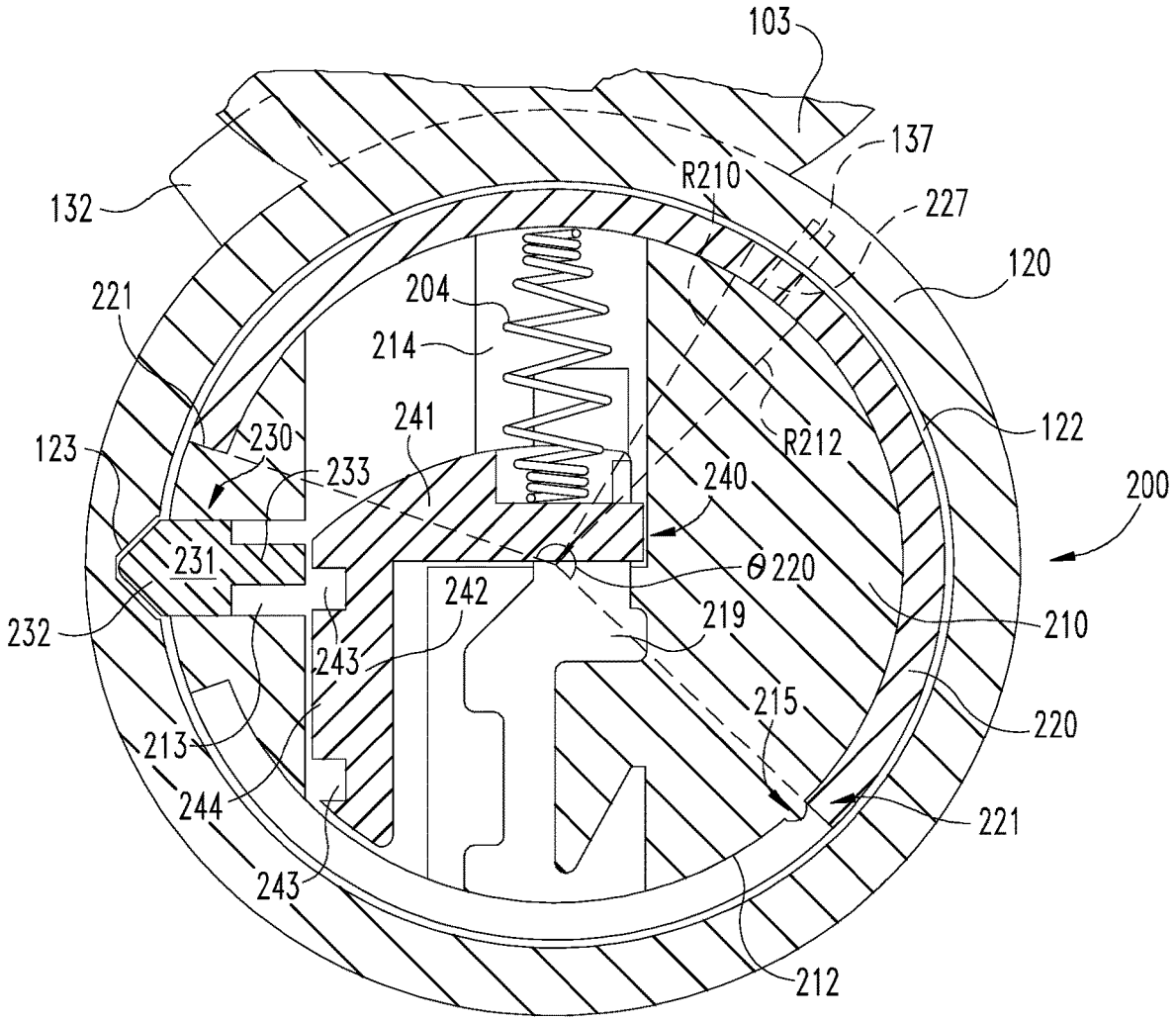
FIG. 3 is a cross-sectional view of the lock cylinder of FIG. 1 in a locked state.

With additional reference to FIGS. 2 and 3, the plug assembly 200 is positioned partially within a generally cylindrical chamber 122 defined by the shell body 120. The plug assembly 200 includes a plug 210, a cover plate 220, a sidebar 230, and a plurality of rack pins 240. The shell body 120 also includes a longitudinal groove 123 configured to receive a portion of the sidebar 230.

The plug 210 includes a faceplate 211, a recessed portion 212, a longitudinal channel 213, a plurality of cavities 214, and a keyway 219 configured to receive a key. The recessed portion 212 is configured as an arcuate portion of the plug 210 and sized and shaped to receive the cover plate 220. The recessed portion 212 has a recess radius R212 which is less than the plug body radius R210. The channel 213 extends in the axial direction of the plug 210, and is configured to the receive the sidebar 230 and the biasing members 203. Each of the cavities 214 is configured to receive a rack pin 240 and a biasing member 204, and is connected to the recessed portion 212, the longitudinal channel 213, and the keyway 219. Upon insertion of a key into the keyway 219, each rack pin 240 can engage both the sidebar 230 and the key.

The cover plate 220 is configured as an arcuate plate including terminal surfaces 221 and slots 225. The inner radius of the cover plate 220 corresponds to the recess radius R212, and the outer radius corresponds to the plug body radius R210. The cover plate 220 is configured to be received in the recess 212 such that the cover plate 220 is rotatably coupled to the plug 210. In the illustrated form, the cover plate 220 comprises an arc having a central angle θ220 greater than 180°, and the terminal surfaces 221 are separated by a distance less than the diameter across the recess 212. While the exemplary cover plate 220 comprises an arc having a central angle θ220 of about 200°, other central angles are also contemplated. In certain embodiments, a cover plate may have a central angle between 185° and 315°, between 190° and 280°, or between 195° and 220°. In other embodiments, the arc may have a central angle less than 180°. An exemplary form of one such cover plate is described below with reference to FIG. 5.

The illustrated cover plate 220 is slightly flexible such that separating the terminal surfaces 221 by a distance corresponding to the diameter across the recess 212 does not cause permanent deformation of the cover plate 220. This in turn allows the cover plate 220 to be installed into the recess 212 by pressing the cover plate 220 into the recess 212 via a snap-fit action. When installed in the recess 212, the cover plate 220 is rotatably clamped to the plug 210. As such, the cover plate 220 can rotate about the longitudinal axis of the plug 210 within the confines of the recess 212, but movement in the radial or axial direction of the plug 210 is substantially prevented. The term "substantially", as used herein, may be applied to modify a quantitative representation which could permissibly vary without resulting in a change in the basic function to which it is related. For example, with radial and axial movement of the cover plate 220 substantially prevented, the cover plate 220 may nonetheless be capable of slight radial and/or axial movement so long as the cavities 214 remain covered.

While the exemplary cover plate 220 is installed in the above-described snap-fit manner, it is also contemplated that the cover plate 220 may be installed by sliding the cover plate into the recess 212 such as, for example, prior to affixing the faceplate 211. Alternatively, the recess 212 may extend to the end of the plug 210 opposite the faceplate 211, and the cover plate 220 may be slid into the recess 212 and retained therein by a ridge or retainer.

The cover plate 220 is rotatable about the longitudinal axis of the plug, 210 between a closed position (FIG. 3) and an open position, and is capable of rotating between the closed position and the open position without being decoupled from the plug 210. In the closed position, the cavities 214 are covered by the cover plate 220, and the rack pins 240 and the biasing members 204 are retained in the cavities 214. When the plug assembly 200 is removed from the shell 101, the closed cover plate prevents the cylinder 100 from "exploding" without requiring the use of a plug follower. In the open position of the cover plate 220, the cavities 214 are exposed, and the rack pins 240 can be inserted into or removed from the cavities 214. This allows the plug assembly 200 to be completely assembled prior to being installed in a shell appropriate for the lock type. The modular nature of the plug assembly 200 enables installation of the same plug in any of a variety of shells corresponding to different lock types.

Rotation of the cover plate 220 from the open position and/or the closed position is resisted by a ridge 215 formed on the plug 210. When the cover plate 220 is in the closed position, the ridge 215 contacts one of the terminal surfaces 221, When the cover plate 220 is in the open position, the ridge 215 is positioned in the slot 225. The distance by which the ridge 215 protrudes from the surface of the recessed portion 212 is great enough to resist incidental rotation of the cover plate 220, but small enough that intentional rotation is not prevented. In other words, the ridge 215 prevents rotation of the cover plate 220 in the absence of a threshold torque being applied to the cover plate 220. In certain embodiments, the ridge 215 may be a bump having a small length in the longitudinal direction. In other forms, the ridge 215 may extend in the longitudinal direction of the plug 210. Additionally, the cross-section of the ridge 215 may be curvilinear, rectilinear, or a combination thereof. In certain embodiments, the plug 210 may include a plurality of ridges, or the ridge 215 may be omitted from the plug body. For example, one or more ridges may be formed on the cover plate 220, and correspondingly shaped grooves may be formed on the plug 210.

The sidebar 230 is positioned in the longitudinal channel 213 and is biased radially outward by the biasing members 203. The sidebar 230 includes a body portion 231, a cam surface in the form of a tapered portion 232 on the radially outer side of body portion 231, and an interference member in the form of a protrusion 233 located on the radially inner side of the body portion 231. In the illustrated form, the interference member 233 includes a pair of recesses, and springs 203 are seated in the recesses and bias the sidebar 230 radially outward. Other than the recesses, the exemplary interference member is a single contiguous protrusion 233. In other embodiments, the interference member may comprise a plurality of discrete protrusions, each configured to engage one of the rack pins 240.

The height of the body portion 231 corresponds to the height of the channel 213 such that movement of the sidebar 230 is substantially confined to the radial direction of the plug 210. In the illustrated form, the height of the protrusion 233 is less than the height of the body portion 231, although it is also contemplated that the body portion 231 and the protrusion 233 may be the same height or substantially the same height. Furthermore, while the tapered portion 232 is depicted as having a substantially rectilinear cross-section, it is also contemplated that the tapered portion 232 may comprise a curvilinear profile.

The rack pins 240 are positioned in the cavities 214 along with the biasing members 204, and each rack pin 240 includes a first leg 241 and a second leg 242. When the cover plate 220 is in the closed position, the biasing members 204 urge the rack pins 240 toward the keyway 219, such that each of the first legs 241 engages a ledge. In the illustrated embodiment, the first leg 241 is arranged perpendicular to the second leg 242, although other configurations are also contemplated. For example, in certain embodiments, the legs 241, 242 may be arranged substantially perpendicular to one another, or may be offset relative to one another by an oblique angle. In the illustrated embodiment, the second leg 242 extends from the end of the first leg 241 in only a single direction, and the rack pin 240 can thus be considered to comprise an L-shaped rack pin.

The first leg 241 is positioned at least partially in the keyway 219 and is configured to travel along the top cut of a key. The first leg 241 may include a tapered bottom surface (i.e., angled or curved) to facilitate such travel. When the key is inserted into the keyway 219, each of the rack pins 240 moves in a lateral direction substantially perpendicular to the longitudinal direction of key insertion as the first leg 241 travels along the top cut of the key. Due to the fact that the biasing members 204 urge the first legs 241 into contact with the key, the position of each of the rack pins 240 corresponds to the root depth of the key at the point of contact. If a rack pin 240 is blocked from moving in the necessary direction, interference between the blocked rack pin 240 and the teeth of the key prevents the key from being inserted or extracted.

The second leg 242 includes at least one notch 243 configured to receive a portion of the protrusion 233. One or more of the rack pins 240 may include more than one notch 243 such that the plug assembly 200 can be master-keyed. When the notch 243 is aligned with the protrusion 233, the protrusion 233 can enter the notch 243. This defines an unlocking position of the rack pin 240 in which the rack pin 240 does not prevent the sidebar 230 from moving radially inward. When the notch 243 is misaligned with the protrusion 233, the protrusion 233 engages a contact surface 244 of the second leg 242. This defines a locking position of the rack pin 240 wherein the rack pin 240 prevents the sidebar 230 from moving radially inward.

The alignment or misalignment of the notch 243 and the protrusion 233 is determined by the vertical position of the rack pin 240, which in turn depends upon the root depth of an inserted key at the corresponding bitting position. When a proper key is inserted, each rack pin 240 is located in the unlocking position with one of its notches 243 aligned with the protrusion 233. This configuration defines an unlocked state of the plug assembly 200 wherein the sidebar 230 is free to move radially inward. When an improper key is inserted, at least one of the rack pins 240 will be positioned in the locking position wherein none of its notches 243 are aligned with the protrusion 233. This configuration defines a locked state of the plug assembly 200 in which the sidebar 230 is prevented from moving radially inward.

Figure 4:
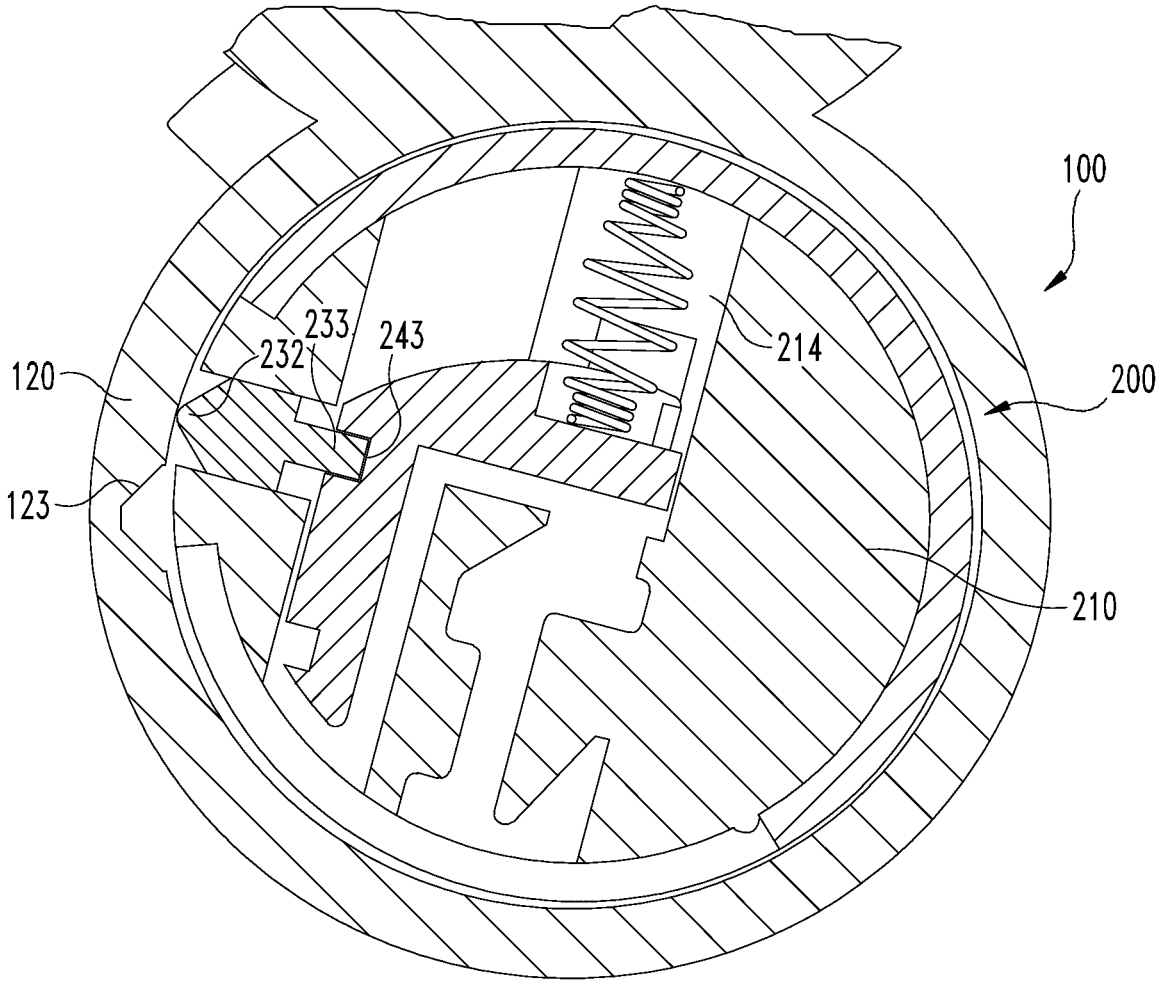
FIG. 4 is a cross-sectional view of the lock cylinder of FIG. 1 in an unlocked state.

With additional reference to FIG. 4, the operation of the cylinder 100 will now be described in further detail. FIG. 3 illustrates the plug assembly 200 in a home position wherein the biasing members 203 urge the sidebar to an extended position in which at least part of the tapered portion 232 is positioned in the groove 123. The plug assembly 200 is also in the locked state since the protrusion 233 is not aligned with the notch 243, and the interaction of the protrusion 233 and the contact surface 244 prevents the sidebar 230 from moving radially inward. In other words, the rack pin 240 retains the sidebar 230 in the extended position. Due to the fact that the sidebar 230 cannot move radially inward, the surfaces of the groove 123 interfere with the tapered portion 232, thereby preventing rotation of the plug assembly 200 with respect to the shell 101. The sidebar 230 is the only element that crosses the shear line of the cylinder 100 as the rack pins 240 are contained within the plug 210 by the cover plate 220.

As described above, when a proper key is inserted into the keyway, each rack pin 240 has a notch 243 aligned with the protrusion 233, and the sidebar 230 is thereby free to move radially inward. In this unlocked state, rotation of the plug assembly 200 causes a surface of the groove 123 to interact with the tapered portion 232, thereby urging the sidebar 230 radially inward. In other words, the surfaces of the groove 123 and the tapered portion 232 are cam surfaces configured to urge the sidebar 230 radially inward upon rotation of the plug assembly 200. Once the plug assembly 200 has been sufficiently rotated, the sidebar 230 is positioned in a retracted position (FIG. 4) wherein the protrusion 233 is received in a notch 243 of each rack pin 240. In this rotated position of the plug assembly 200, the tapered portion 232 is positioned in contact with an inner surface of the shell 101, thereby retaining the protrusion 233 within the notches 243. As noted above, in order for the key to be inserted into or extracted from the keyway 219, the rack pins 240 must be free to travel. In the rotated position of the plug assembly 200, however, such travel is blocked due to the protrusion 233 being retained within the notch 243. As such, when the plug assembly 200 is in the rotated position, the key cannot be extracted.

As the plug assembly 200 is rotated back to the home position, the biasing members 203 urge the sidebar 230 radially outward into the groove 123. The protrusion 233 is thus removed from the notch 243, and the rack pins 240 again become free to travel, thereby permitting extraction of the key. Once the key is extracted, the biasing members 204 urge the rack pins 240 to their initial positions (FIG. 3) wherein the protrusion 233 is misaligned with the notches 243, and the plug assembly 200 is positioned in the locked state.

With continued reference to FIGS. 1-4, the exemplary lock cylinder 100 also includes a control member 130. The control member 130 is rotatable with respect to the shell 101 and includes a control lug 132 configured to engage a corresponding notch in the cylinder housing. In a first angular position of the control member 130 (FIG. 1), the control lug 132 radially protrudes from the shell 101 into the cylinder housing notch, thereby preventing the cylinder 100 from being removed from the cylinder housing. When the control member 130 is rotated to a second angular position, the control lug 132 is positioned within the tower 103, and the cylinder 100 can be removed from the cylinder housing.

As illustrated in FIG. 2, the plug 210 may further include a control pin cavity 217, and the cover plate 220 may further include an opening 227. The control pin cavity 217 and the opening 227 are positioned such that, when the cover plate 220 is in the closed position, the opening 227 is aligned with the control pin cavity 217. When the plug assembly 200 is in the home position (FIG. 3) and the cover plate 220 is in the closed position, the control pin cavity 217 and the opening 227 are aligned with a correspondingly-sized cavity formed in the control member 130. The control pin cavity 217 has disposed therein a control pin operable in a first position in which a portion of the control pin extends into the control member cavity, and a second position in which the control pin does not extend into the control member cavity. The control pin is configured to interact with and engage a feature of a control key wherein the control pin is in the first position when a proper control key is inserted in the keyway 219, and is in the second position when a proper control key is not so inserted.

When a proper control key is inserted, the plug assembly 200 is positioned in the unlocked state and the control pin is in the first position. In this state, rotation of the plug 210 also causes rotation of the control member 130 due to the control pin extending into the control member cavity. Once the control member 130 is in the second angular position, the control lug 132 is positioned within the tower 103, and the cylinder 100 can be removed from the cylinder housing in certain embodiments, the control pin may interact with sidemilling on the control key such that the position of the control pin is independent of the key top cut, thereby providing more security and control.

Once the cylinder 100 has been removed from the cylinder housing, the plug assembly 200 can be removed from the shell 101 for re-pinning. In order to re-pin the plug assembly 200, a user rotates the cover plate 220 from the closed position to the open position, wherein the cover plate 220 may be retained by the ridge 215. The user removes at least some of the springs 204 and the rack pins 240 from the cavities 214. The user may simply rearrange some of the rack pins 240 (i.e., by placing at least some of the rack pins 240 in different cavities 214), may replace one or more of the rack pins 240 with new rack pins, or a combination thereof. The springs 204 are then placed back into the cavities 214, and the cover plate 220 is rotated back to the closed position, where the cover plate 220 is retained by the ridge 215. The user next inserts the plug assembly 200 into the shell 101 (or another shell of the same, similar, or different format), inserts the cylinder 100 into the cylinder housing, and rotates the plug assembly 200 and the control member 130 to a position in which the control lug 132 prevents removal of the cylinder 100 from the cylinder housing. Because the plug assembly 200 is self-contained, there is no need to position springs and driving pins in the shell 101 during assembly, thereby reducing the time and complexity of the pinning process.

Figure 5:
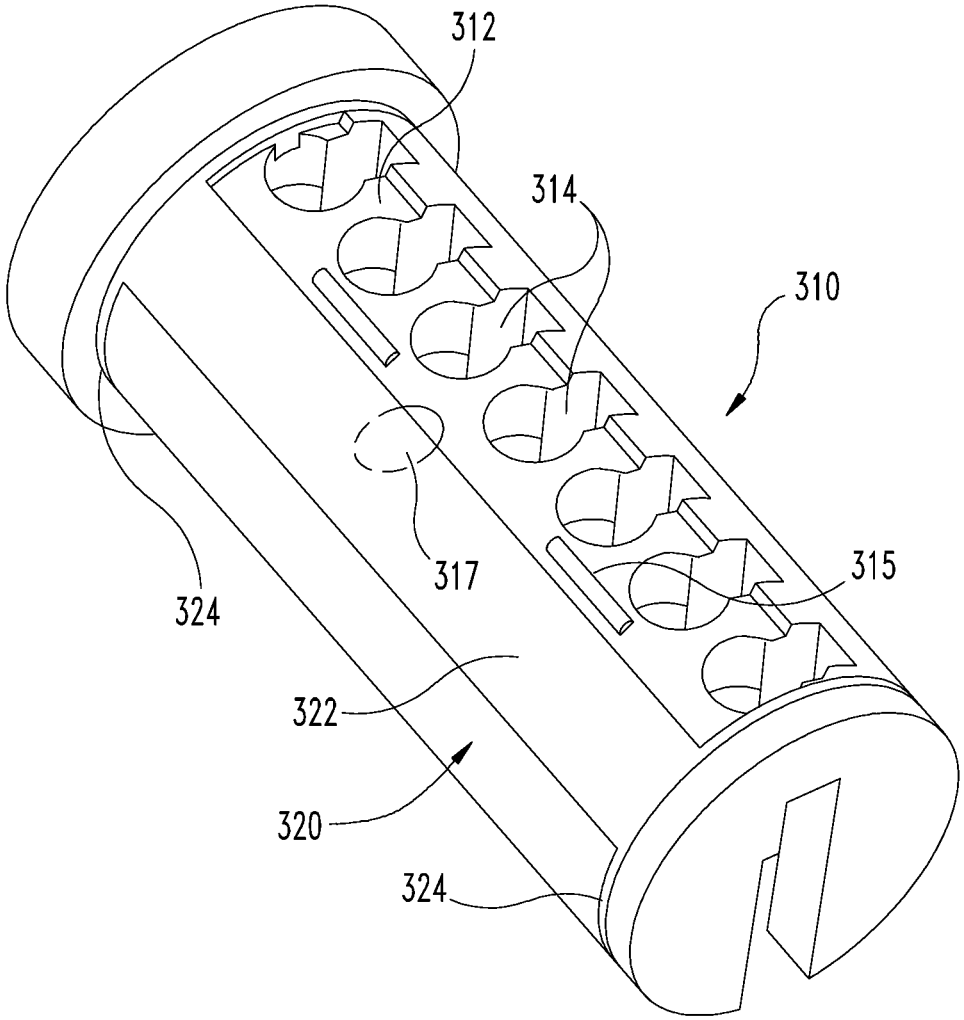
FIG. 5 is a perspective illustration of a plug body and cover plate according to an embodiment of the present invention.
Figure 5A:
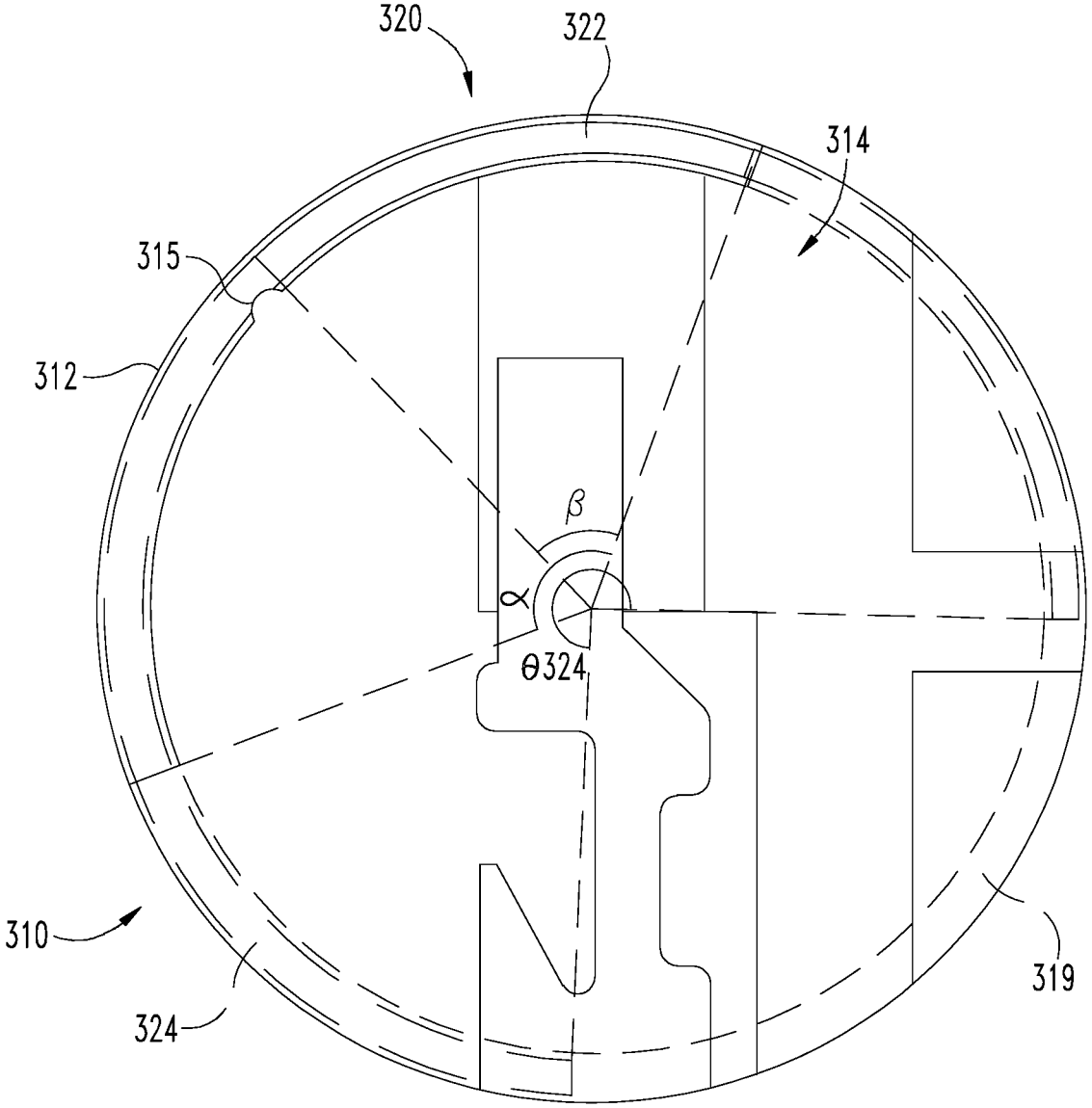
FIG. 5*a* is a cross-sectional illustration of the plug body and cover plate illustrated in FIG. 5.

FIGS. 5 and 5*a* illustrate a second exemplary plug 310 and a cover 320. The plug 310 is configured substantially similar to the plug 210 and includes a recessed portion 312 having a radius less than that of the remainder of the plug 310, and a plurality of cavities 314 configured to receive rack pins such as the rack pins 240. The recessed portion 312 constitutes an arcuate portion of the plug 310. The central angle of the arc defined by the recessed portion is hereinafter referred to as the recess angle α.

The cover 320 includes a cover plate 322 positioned in the recessed portion 312, and keepers 324 which rotatably couple the cover 320 to the plug 310. The cover plate 322 is arcuate in geometry and has a central angle hereinafter referred to as the cover plate angle β. The cover plate 322 has an inner radius corresponding to the radius of the recessed portion 312, and an outer radius corresponding to the outer radius of the plug 310. The keepers 324 may be positioned in a circumferential groove 319 on the plug 310. In the illustrated embodiment, the arcuate keepers 324 have a central angle θ324 of greater than about 190° and less than about 300°, and are snap-fit into the circumferential groove 319 in a manner similar to that described above with respect to the cover plate 220. In other embodiments, the keepers 324 may have a greater central angle, which may be up to 360°. In other words, the keepers 324 may be complete circles circumferentially surrounding a portion of the plug 310. In still further embodiments, the keepers 324 may have a lesser central angle, and may be positioned in grooves on the faceplate and/or the end of the plug 310 opposite the faceplate.

The cover plate 322 is rotatable about the longitudinal axis of the plug 310 along the recess 312. In an open position of the cover plate 322, the cavities 314 are exposed, and rack pins and biasing members can be inserted into or removed from the cavities 314. With the cover 320 in a closed position, the cavities 314 are covered and the pins and springs are retained within the cavities 314. In the illustrated embodiment, the plug 310 includes two ridges 315 which extend along the axial direction of the plug 310, and are configured to resist rotation of the cover plate 322 from the closed position. The ridges 315 may be configured substantially similar to the ridge 215, and the descriptions of the illustrated and alternative features of the ridge 215 are equally applicable to the ridges 315.

In the illustrated embodiment, the recess angle α is slightly greater than twice the cover plate angle β, and the ridges 315 bisect the recessed portion 312 into first and second recessed sections, and with the angular span of each corresponding to the cover plate angle β. For example, if the cover plate angle β is 30°, the recess angle α may be between about 62° and about 70°. As such, the cover plate 322 can be stably positioned in either the open position or the closed position, and the ridges 315 will retain the cover plate 322 in the selected position until the user rotates the cover plate 322 to the new position. In this manner, the ridges 315 facilitate the pinning process and ensure that the cover plate 322 remains in the closed position when installed into a shell (such as the previously-described shell 101).

While the cover plate 322 comprises an arc having a central angle of about 30°, other central angles are contemplated. In certain embodiments, the cover plate 322 may comprise an arc having a central angle between 10° and 180°, between 15° and 90°, or between 20° and 45°. In certain embodiments, the recess angle α may be more than twice the cover plate angle β. In further embodiments, the recess angle α may be less than twice the cover plate angle β, in which case the cover plate 322 may include slots configured engage the ridges 315 when the cover plate 322 is in the open or closed position in a manner similar to that described with reference to the slots 225. Furthermore, in certain embodiments, the ridges 315 need not bisect the recessed portion 312.

A common form of picking locks includes applying torque to a lock plug and adjusting the position of a pin until the resistive force provided by the pin changes. This change in resistive force is interpreted by the picker as an indication that the pin or tumbler is aligned with the shear line, and will in turn no longer prevent rotation of the plug. The process is repeated until each of the pins is in the unlocking position, and the plug can then be rotated. To combat such picking, certain embodiments of the invention may include anti-tampering features. An exemplary form of such anti-tampering features will now be described with reference to FIGS. 2 and 6.

Figure 6:
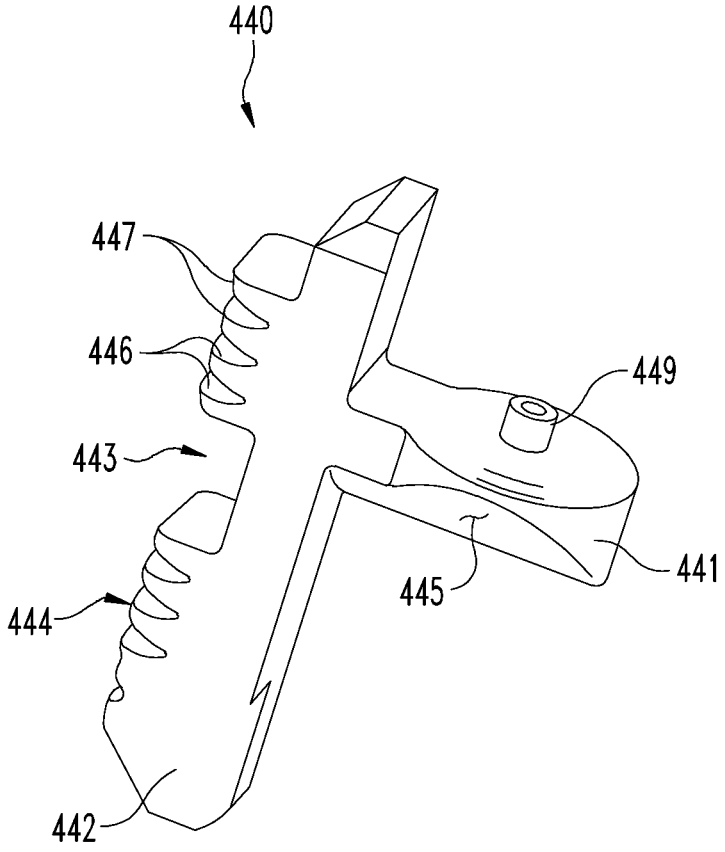
FIG. 6 is a perspective illustration of a rack pin according to an embodiment of the invention.

FIG. 6 depicts an alternative form of the rack pin 440 which may be utilized in certain embodiments of the invention. The rack pin 440 is substantially similar to the previously-described rack pins 240, and similar reference characters are used to denote similar features. In the interest of conciseness, the following description focuses primarily on features which are different than those previously described with reference to the rack pins 240.

In the present form of the rack pin 440, the second leg 442 includes upper and lower portions extending from the first leg 441 in opposite directions, thereby defining the rack pin 440 as a T-shaped rack pin. The upper and lower portions may engage the walls of the rack pin cavities 214, thereby substantially constraining motion of the rack pin 440 to a lateral axis parallel to the second leg 442 during key insertion.

The second leg 442 also includes a plurality of false gate notches 446 formed in the contact surface 444. Each of the false gate notches 446 is defined by a pair of adjacent protrusions 447. If an unauthorized person attempts to pick the lock using the above-described method, the torque provided by the picker urges the sidebar 230 radially inward, and the protrusion 233 in turn comes into contact with the contact surface 444. When the picker adjusts the position of the rack pin 440 with a picking tool, the sidebar protrusion 233 engages one of the false gate notches 446 or the protrusions 447, thereby changing the resistive force provided by the rack pin 440. The picker will falsely interpret this change in resistive force as indication that the rack pin 440 is in an unlocking position. Because the rack pin 440 is actually in the locking position, however, the engagement of the sidebar protrusion 233 and the contact surface 444 prevents rotation of the plug assembly 200, as described in detail above.

The first leg 441 also includes features which differ from the depictions of the first leg 241. For example, the first leg 441 includes a tapered portion 446 configured to facilitate travel of the rack pin 440 along the top cut of the key during key insertion. The tapered portion 446 may have a shape corresponding to the bitting length and tooth angle which are standard for a particular form of key. In such cases, the tapered portion 446 may be positioned flush with adjacent teeth when the key is fully inserted such that the rack pin 440 substantially prevents movement of the key in either direction when the plug assembly 200 is in the rotated position. The first leg 441 may also include a hub 449 configured to be received in one end of a spring 204 to prevent the spring 204 from sliding out of engagement with the first leg 441 during operation.

While the figures depict only the L-shaped rack pin 240 and the T-shaped rack pin 440, other forms of rack pin are also contemplated. In certain embodiments, one or more of the rack pins may include a third leg on the opposite side of the first leg from the second leg. In such embodiments, the second and third leg may each extend in only one direction (i.e., U-shaped configuration), may both extend in opposing directions (H-shaped configuration), or one of the vertical legs may extend in both directions and the other may extend in only one direction (h-shaped configuration). In such embodiments, the third leg may include sidebar-receiving notches, and the plug assembly 200 may include a second sidebar similar to the sidebar 230, which in turn prevents rotation of the plug assembly 200 when the protrusion of the second sidebar is not aligned with the notches in the third leg.

Figure 7:
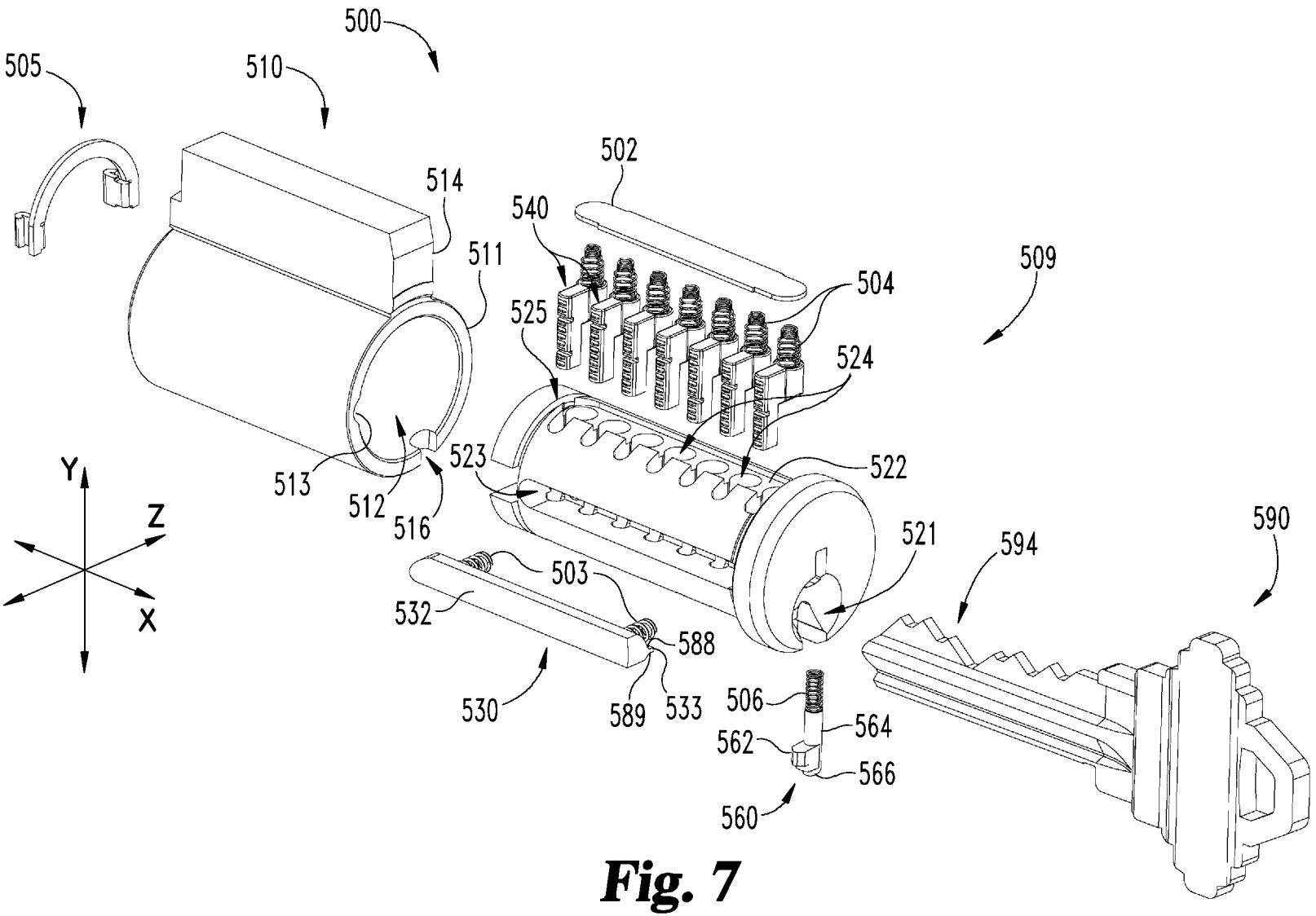
FIG. 7 is an exploded assembly illustration of a lock cylinder according to another embodiment.
Figure 8:
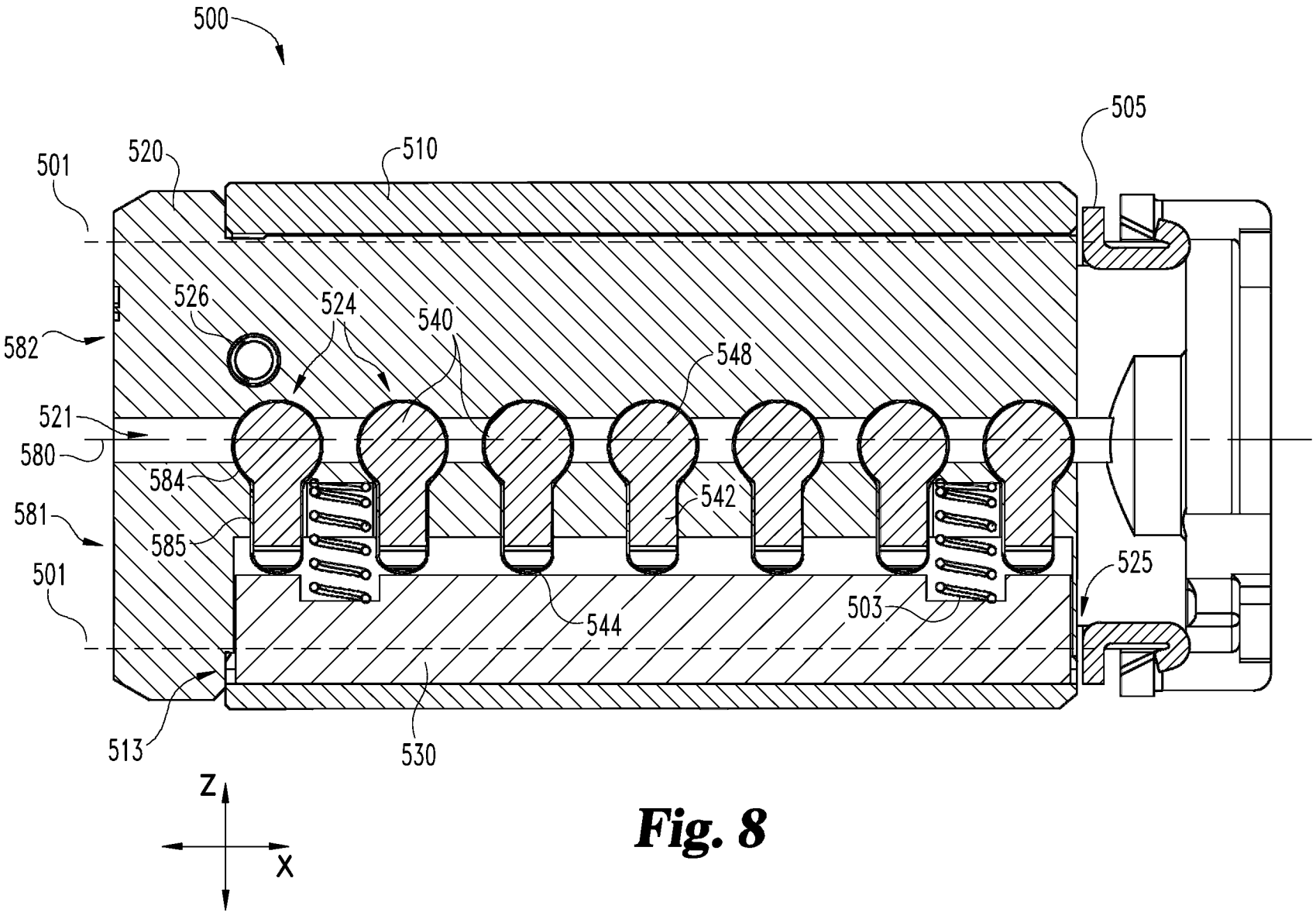
FIG. 8 is a top-down cross-sectional illustration of the lock cylinder depicted in FIG. 7.

With reference to FIGS. 7 and 8, a lock cylinder 500 according to another embodiment includes a shell 510, a plug 520 rotatably mounted in the shell 510, a sidebar 530 movably coupled to the plug 520, and a plurality of rack pins 540 seated in the plug 520 and operable to selectively prevent movement of the sidebar 530. The cylinder 500 is operable by a key 590, and may further include a check pin 560 movably seated in the plug 520.

In the illustrated form, the shell 510 is of the key-in-lever format and includes a shell body 511 and a narrow bible or tower 514 extending, from the shell body 511. The shell body 511 defines a generally cylindrical chamber 512 and a longitudinal groove 513. In embodiments in which the cylinder 500 includes the check pin 560, the shell 510 may also include a recess 516 sized and configured to receive a portion of the check pin 560.

The plug 520 is rotatably mounted in the chamber 512, and a shear line 501 is formed between the outer surface of the plug 520 and the inner surface of the shell 510. As will be appreciated, the shear line 501 is an annular boundary which circumferentially surrounds the plug 520. The plug 520 includes a keyway 521, a longitudinal channel 523 sized and configured to receive the sidebar 530, and a plurality of rack pin cavities 524 in communication with the keyway 521 and the channel 523. The keyway 521 extends along a longitudinal axis X and a lateral axis Y. The longitudinal and lateral axes X, Y define an imaginary boundary plane 580 which divides the plug 520 into a first plug section 581 and a second plug section 582. The plug 520 may also include an annular channel 525, and the cylinder 500 may further include a clip 505 to prevent the plug 520 from being removed from the shell 510. As illustrated in FIG. 8, the clip 505 may be received in the annular channel 525 and abut a distal end of the shell 510. As described in further detail below, the plug 520 may also include a longitudinal trough 522 and/or a check pin cavity 526.

The sidebar 530 is seated in the longitudinal channel 523 and is biased in a radially outward direction such as, for example, via the springs 503. The sidebar 530 includes a radially outer cam suffice or tapered portion 532 and a radially inner interference member 533. When the plug 520 is in a home position, the sidebar 530 crosses the shear line 501 and the tapered portion 532 is received in the groove 513.

The sidebar 530 has an outer position, an inner position, and an intermediate position. In the outer position, the sidebar 530 crosses the shear line 501, and the tapered portion 532 is received in the groove 513. When a torque is applied to the plug 520, engagement between the tapered portion 532 and the surface of the groove 513 causes the sidebar 530 to cam radially inward by a small amount to the intermediate position. In the intermediate position, the sidebar 530 crosses the shear line 501, and the tapered portion 532 is engaged with a tapered surface of the groove 513. If the sidebar 530 is blocked from further radially inward movement by one or more of the rack pins 540, the sidebar 530 prevents further rotation of the plug 520. If the sidebar 530 is free to travel radially inward, rotation of the plug 520 causes the sidebar 530 to cam radially inward to the inner position as the tapered portion 532 travels along the tapered surface of the groove 513 and into contact with the inner surface of the shell 510. In the inner position, the sidebar 530 is received within the longitudinal channel 523, and does not cross the shear line 501. As such, further rotation of the plug 520 is enabled.

Figure 9:
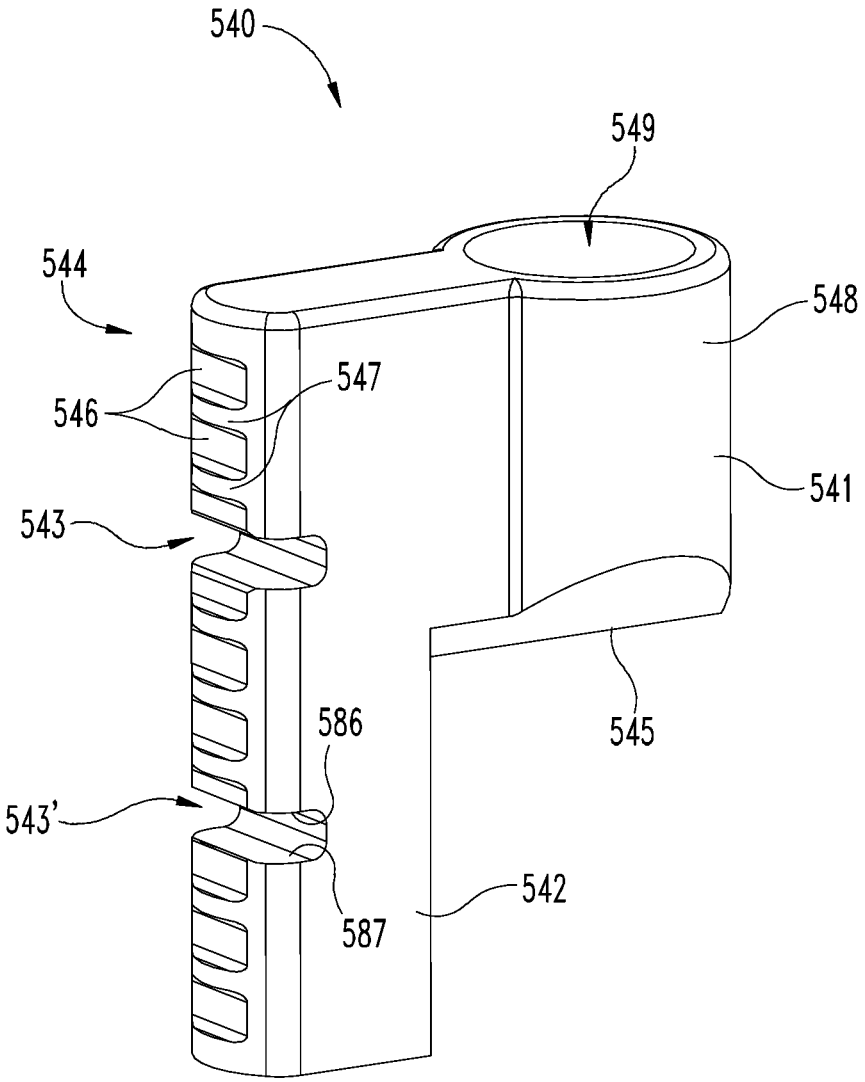
FIG. 9 is a perspective illustration of a rack pin used in the lock cylinder depicted in FIG. 7.
Figure 10:
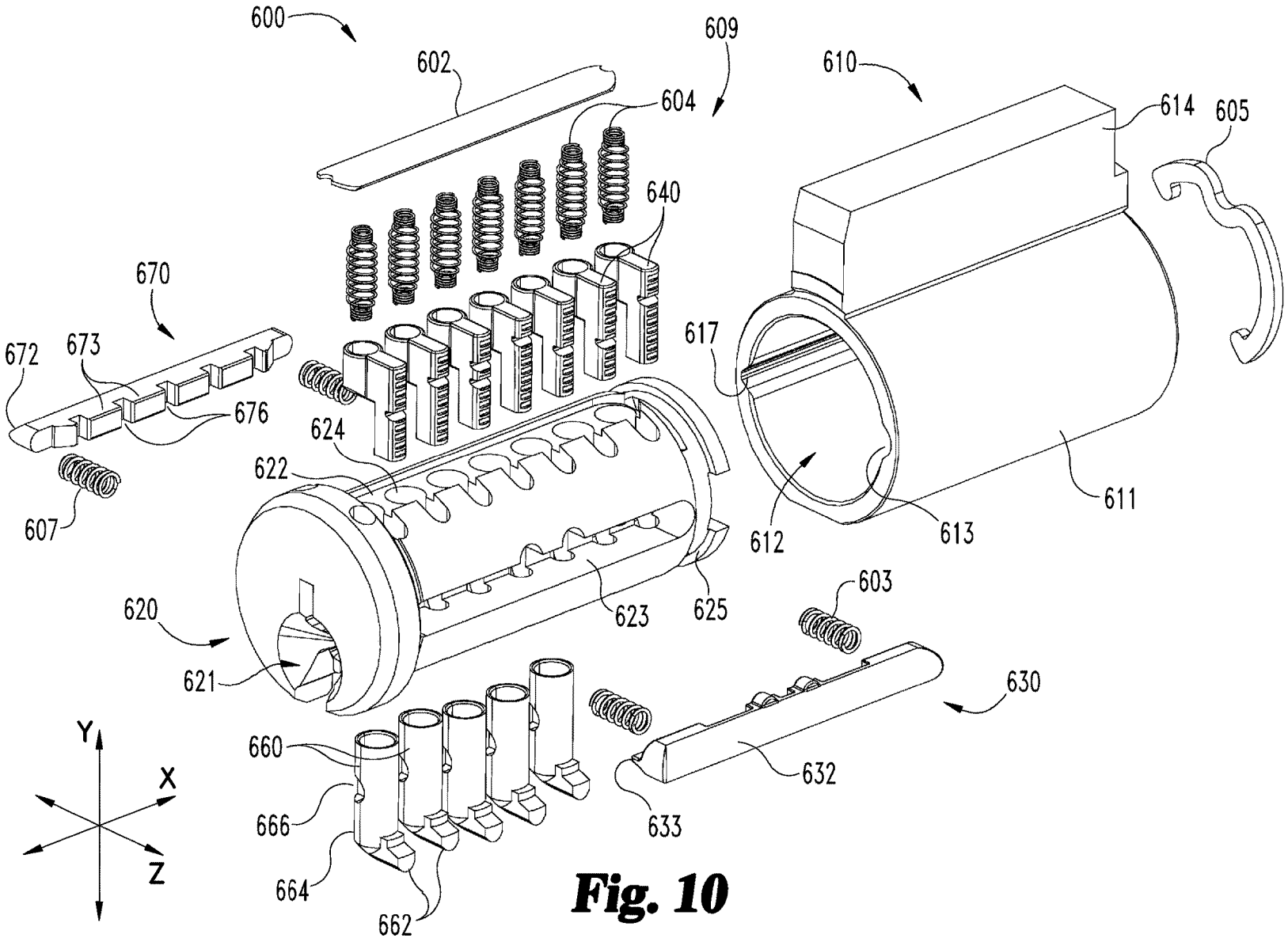
FIG. 10 is an exploded assembly illustration of a lock cylinder according to another embodiment.
Figure 11:
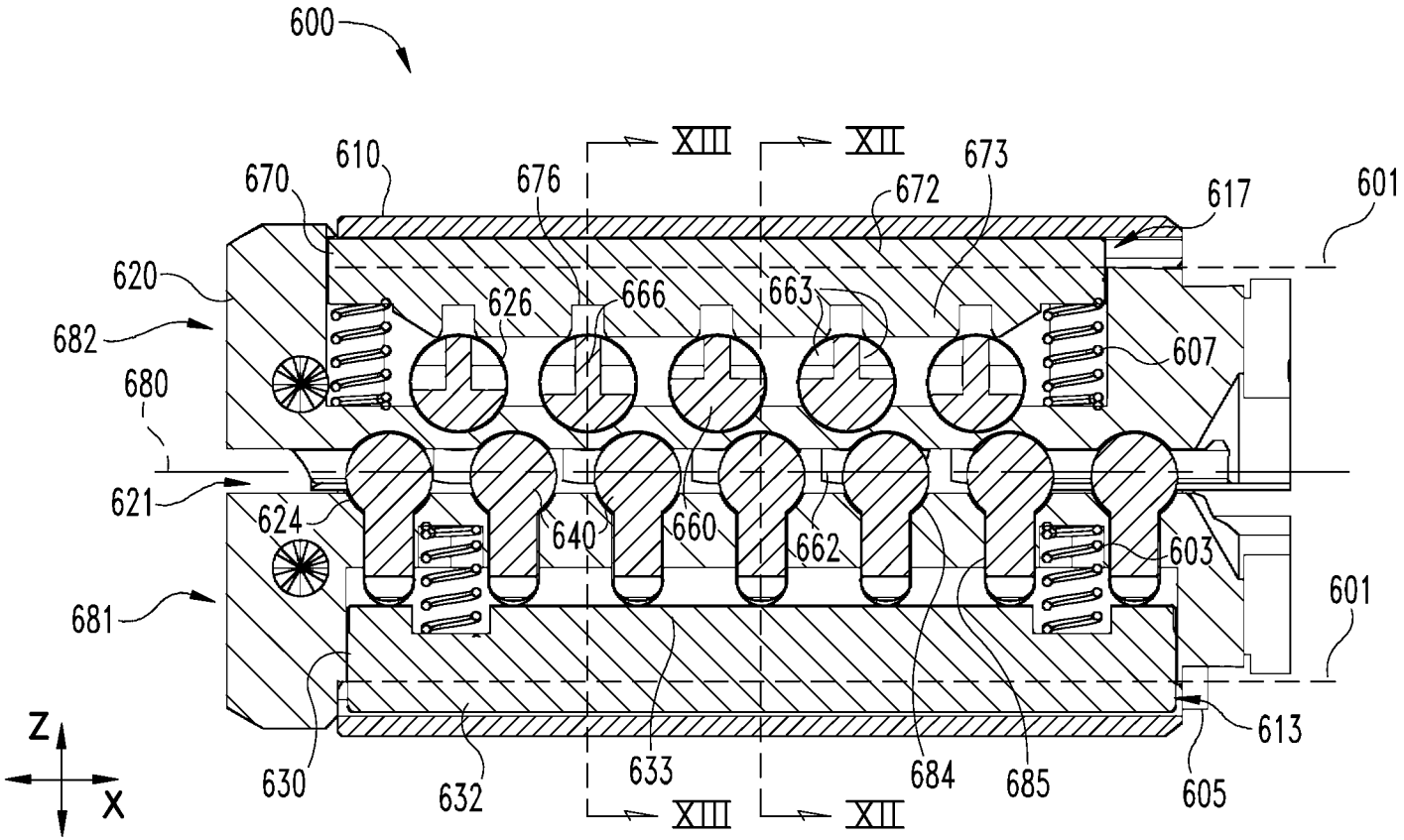
FIG. 11 is a top-down cross-sectional illustration of the lock cylinder depicted in FIG. 10.
Figure 13:
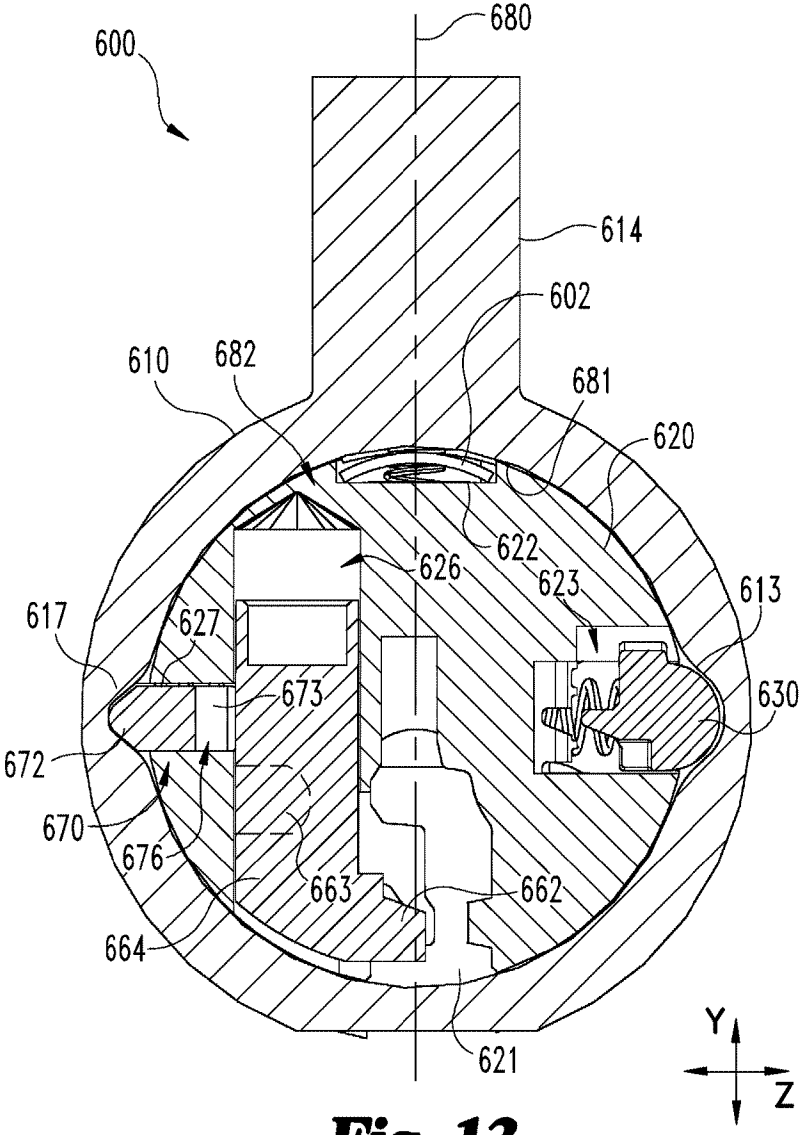
FIG. 13 is a cross-sectional illustration of the lock cylinder depicted in FIG. 10 taken along the cut line depicted in FIG. 11.
Figure 12:
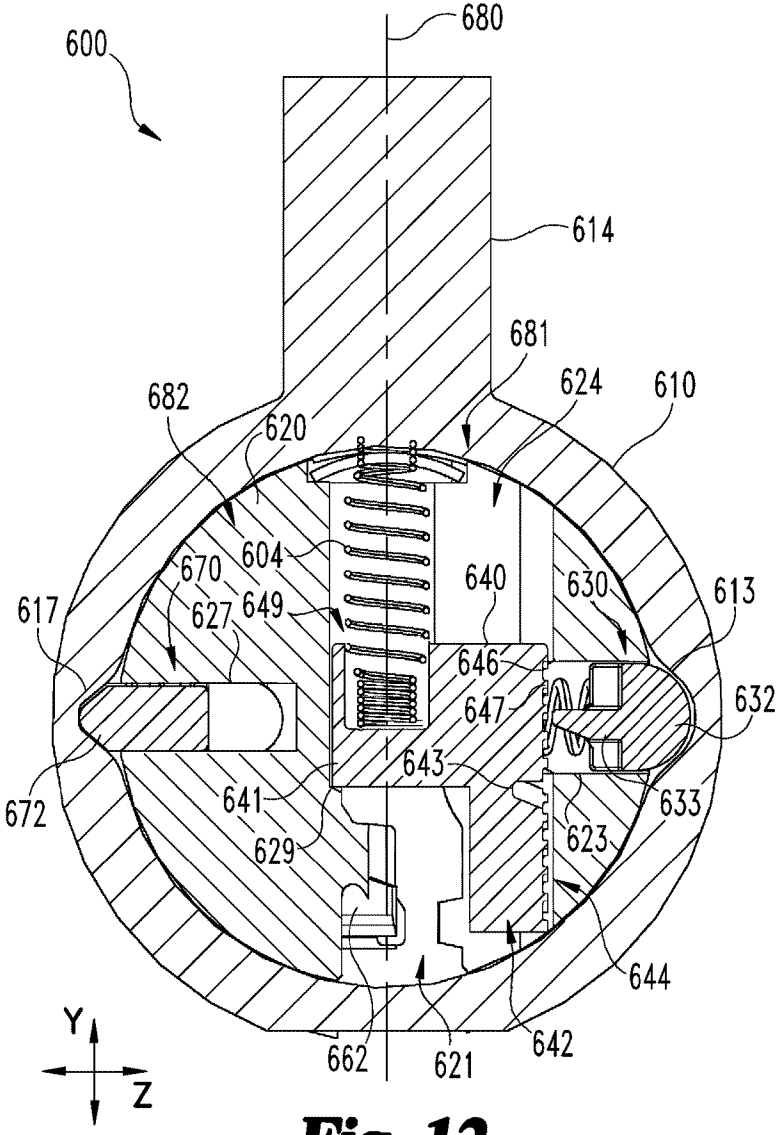
FIG. 12 is a cross-sectional illustration of the lock cylinder depicted in FIG. 10 taken along the cut line XII-XII depicted in FIG. 11.

With additional reference to FIG. 9, each rack pin 540 includes a first or key-engaging leg 541 and a second or sidebar-engaging leg 542. As with the above-described rack pins 240, 440, each rack pin 540 is configured as a single-piece, unitary structure, and the first and second legs 541, 542 are integrally formed with one another. The first leg 541 includes a key-following surface 545 configured to engage an edge-cut 594 on the key 590. The first leg 541 also includes a cylindrical portion 548, which in turn defines a cup 549 sized and configured to receive a portion of a spring 504. The second leg 542 is arranged substantially perpendicular to the first leg 541, and includes a contact surface 544 which faces the sidebar 530. The contact surface 544 includes at least one receiving notch or true gate 543 and a plurality of shallow notches or false gates 546.

As illustrated in FIG. 8, each rack pin cavity 524 includes a first runner 584 configured to receive the first leg 541, and a second runner 585 configured to receive the second leg 542. The first runner 584 includes a circular portion configured to receive the cylindrical portion 548 of the first leg 541. The first runner opens to the keyway 521 and extends in a first lateral direction (illustrated as an upward direction) therefrom. As an edge-cut key 590 is inserted into the keyway 521, the key-following surfaces 545 of the first legs 541 travel along the edge-cut bitting profile 594. The second runner 585 extends in a second lateral direction (illustrated as a downward direction) front the first runner 584. The second runner opens to the longitudinal channel 523 such that the true gates 543 become selectively aligned with the interference member 533 as the rack pins 540 travel in the lateral directions. While other forms are contemplated, in the illustrated embodiment, the circular portion of each first runner 584 is centered on the boundary plane 580, and each of the second runners 585 is formed in the first plug section 581.

Each of the false gates 546 is formed between a pair of adjacent protrusions 547 which define the lateral widths of the false gates 546. The lateral widths of the true gate 543 and each of the false gates 546 is sufficient to receive a portion of the interference member 533. As a result, when the interference member 533 is aligned with one of the true gates 543 or one of the false gates 546, the interference member 533 will enter the aligned gate as the sidebar 530 cams radially inward to the intermediate position. Each false gate 546 also has a transverse depth which is less than the depth of the true gate 543. When the interference member 533 is aligned with one of the false gates 546, the rear surface of the false gate 546 prevents the sidebar 530 from camming radially inward to the inner or unlocking position. As such, the sidebar 530 is retained in the intermediate position, and further rotation of the plug 520 is prevented. Additionally, when the interference member 533 is received in one of the false gates 546, engagement between the interference member 533 and the adjacent protrusions 547 prevents the rack pin 540 from moving to a position in which the true gate 543 is aligned with the interference member 533. In other words, the rack pin 540 is retained in a locking position and is unable to move to an unlocking position.

In the illustrated form, each of the true gates 543 is defined, by an upper surface 586 and a lower surface 587. Similarly, the interference member 533 is defined by an upper surface 588 and a lower surface 589. Each of the surfaces 586-589 is arranged substantially perpendicular to the boundary plane 580 such that the interference member 533 and the true gates 543 are provided with correspondingly-shaped cross-sections which may be substantially rectangular. As described in further detail below, it is also contemplated that the interference member 533 and/or the true gates 543 need not be provided with a rectangular cross-section.

As noted above, the cylinder 500 may also include a check pin 560 seated in a check pin cavity 526 formed in the plug 520. The check pin 560 includes an arm 562 extending into the keyway 521, and a cylindrical body 564 positioned in the check pin cavity 526. The body 564 also includes an extension 566 extending beyond the arm 562. The check pin 560 is operable in a locking position and an unlocking position, and may be biased toward the locking position by a spring 506. In the locking position, the body 564 is positioned in the plug 520 and the extension 566 is received in the recess 516 formed in the shell 510. The check pin 560 thus crosses the shear line 501, and thereby prevents rotation of the plug 520. In the unlocking position, the check pin 560 does not cross the shear line 501, and therefore does not prevent rotation of the plug 520. The key 590 may include a ramp configured to urge the arm 562 radially inward, thereby moving the check pin 560 to the unlocking position when the key 590 is fully inserted.

In the illustrated embodiment, the plug 520 includes a longitudinal trough 522 connected with the circular portions of the first runners 584, and the cylinder 500 further includes a cover plate 502 seated in the trough 522. During assembly, the rack pins 540 may be inserted into the rack pin cavities 524, and springs 504 may be inserted into the cups 549. The cover plate 502 may be subsequently placed in the trough 522, thereby retaining the springs 504 and rack pins 540 within the rack pin cavities 524. In certain forms, the cover plate 502 may be securely coupled to the plug 520 such as, for example, by a swaging operation. In other embodiments, the cover plate 502 may be releasably coupled to the plug 520 such as, for example, by clips. In further embodiments, the cover plate 502 may simply be retained within the trough 522 by the inner surface of the shell 510. It is also contemplated that the cover plate 502 may be omitted. For example, the rack pin cavities 524 may be in the form of blind bores which open at only one end. In such embodiments, the springs 504 and rack pins 540 may be inserted through the side of the plug 520 opposite the illustrated trough 522.

With reference to FIGS. 10-13, a lock cylinder 600 according to another embodiment includes a shell 610, a plug 620, a first sidebar 630, and a plurality of rack pins 640, each of which is sized and shaped substantially similar to those described above with reference to the lock cylinder 500. The cylinder 600 also includes a plurality of finger pins 660 and a second sidebar 670. As described in further detail below, in certain embodiments, the cylinder 600 may be considered to include a shell 610 and a plug assembly 609, which constitute the remaining elements of the cylinder 600.

Each of the finger pins 660 is seated in a finger pin cavity 626 formed in the plug 620. More specifically, each finger pin cavity 626 is formed in the second plug section 682. Each finger pin 660 includes a finger 662 which extends into the keyway 621. Each finger pin 660 also includes a cylindrical body 664 which includes a pair of recesses 663 defining a ridge 666.

The second sidebar 670 is seated in a longitudinal channel 627 formed in the plug 620. The longitudinal channel 627 is formed in the outer surface of the second plug section 682 and is connected with the finger pin cavities 626. The second sidebar 670 is biased in a radially outward direction such as, for example, by one or more springs 607. The second sidebar 670 includes a cam surface or tapered portion 672 formed on a radially outer side thereof. The second sidebar 670 also includes an interference member 673 formed on a radially inner side thereof. The interference member 673 has formed therein a plurality of gaps 676. The interference member 673 and gaps 676 are sized and configured to matingly engage the recesses 663 and ridges 666 of the finger pins 660. In other words, the recesses 663 are operable to receive the interference member 673, and the gaps 676 are operable to receive the ridges 666.

The second sidebar 670 has an outer position and an inner position. In the outer position, the second sidebar 670 crosses the shear line 601 and the tapered portion 672 is received in a correspondingly shaped groove 617 formed in the shell 610. When the second sidebar 670 is blocked from radially inward movement, interference between the shell 610 and the sidebar 670 prevents rotation of the plug 620. When the second sidebar 670 is free to move radially inward, engagement between the groove 617 and the tapered portion 672 causes the sidebar 670 to cam radially inward to the inner position in response to rotation of the plug 620.

Each of the finger pins 660 has a locking position and an unlocking position. In the locking position, the recesses 663 are misaligned with the interference member 673 and/or the ridge 666 is misaligned with the gap 676. When in the locking position, the finger pin 660 prevents the second sidebar 670 from camming radially inward. More specifically, when the second sidebar 670 moves radially inward, the interference member 673 comes into contact with the body 664 and/or the ridge 666.

Figure 14:
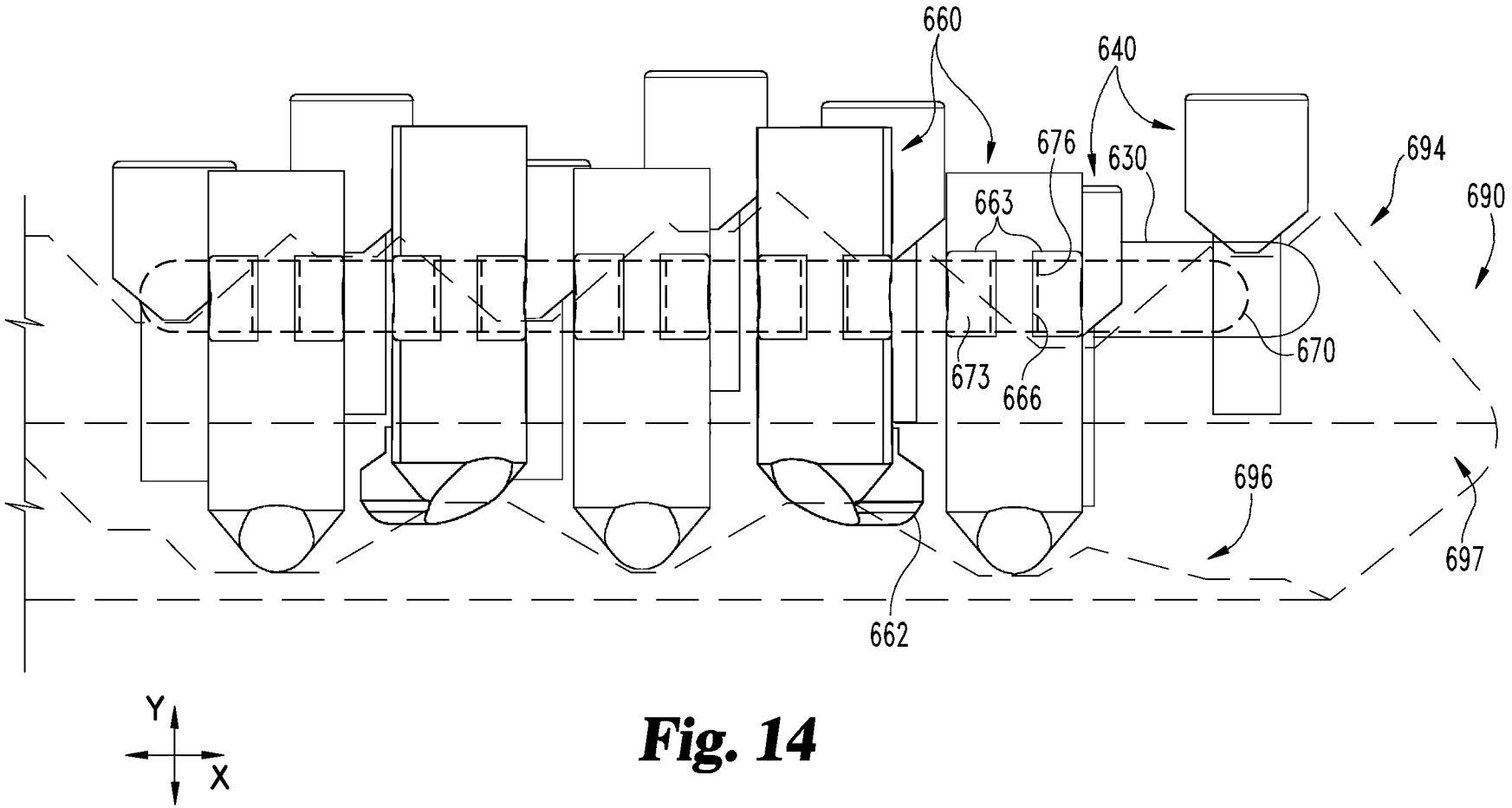
FIG. 14 illustrates a subassembly of the lock cylinder depicted in FIG. 10 with a key.
Figure 15:
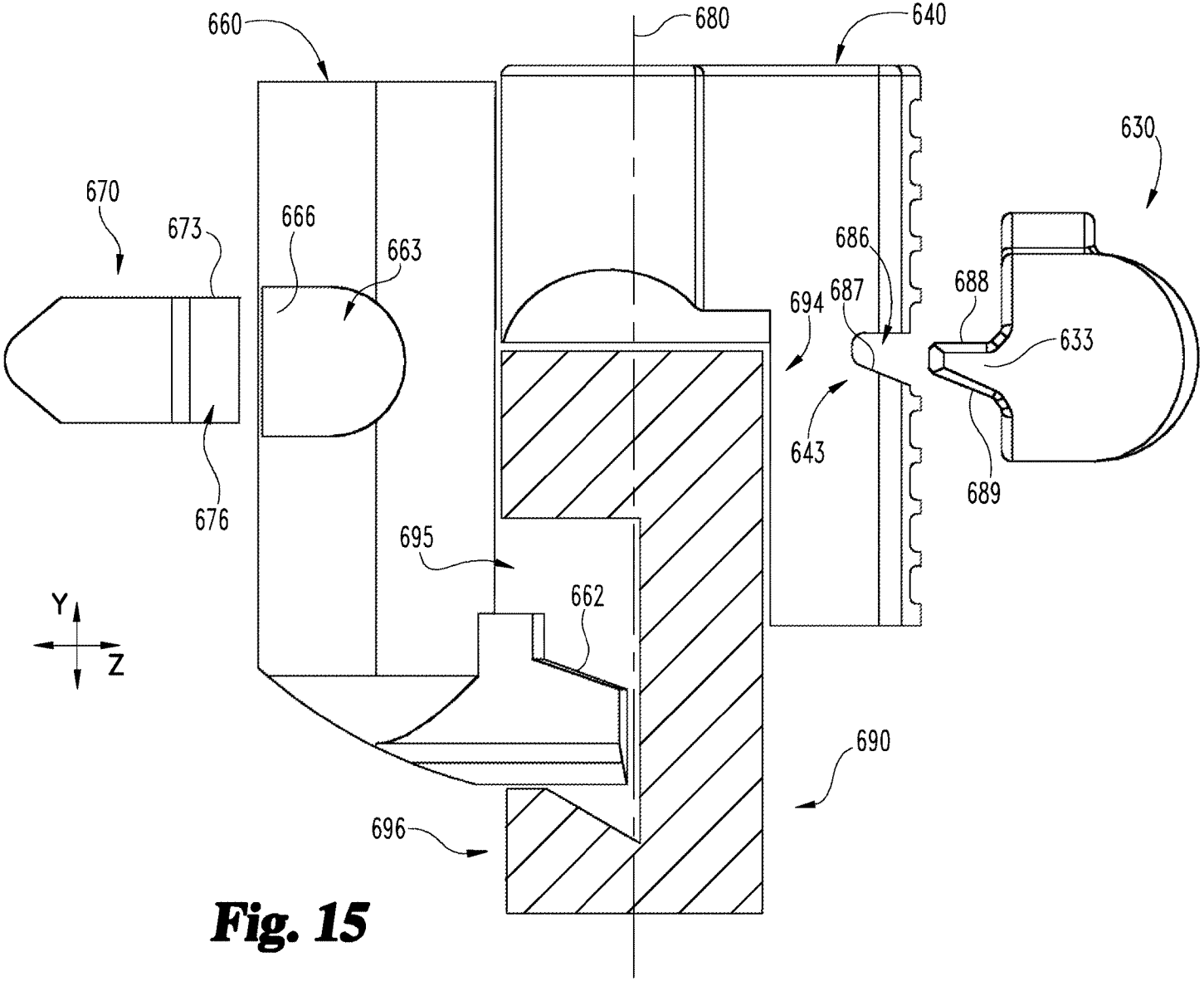
FIG. 15 is an elevation& illustration of the subassembly depicted in FIG. 14

With additional reference to FIGS. 14 and 15, the cylinder 600 is operated by a key 690 including a first bitting profile 694 and a second bitting profile 696. The first bitting profile 694 is formed in a narrow edge of the key 690 and is configured to index the rack pins 640 to the unlocking positions. The second bitting profile 696 is formed in a broad side surface of the key 690 and is configured to index the finger pins 660 to the unlocking positions.

As the key 690 is inserted into the keyway 621, the fingers 662 of the finger pins 660 enter a groove 697 in which the second hitting profile 696 is formed. The second bitting profile 696 engages the fingers 662, thereby causing the finger pins 660 to slide and rotate within the finger pin cavities 626. When the key 690 is fully inserted, each of the rack pins 640 and finger pins 660 is in the unlocking position. More specifically, the first sidebar interference member 633 is aligned with a true gate 643 in each of the rack pins 640, the second sidebar interference member 673 is aligned with each of the recesses 663, and each of the ridges 666 is aligned with a corresponding one of the gaps 676. As a result, each of the sidebars 630, 670 is free to cam radially inward, and the plug 620 can thereby be rotated.

As noted above, the rack pins 640 are movable in first and second lateral directions. In FIGS. 12-15, the lateral axis Y is depicted as a vertical axis, and the first and second lateral directions are illustrated as upward and downward directions. In the interest of clearly and concisely describing the disclosed subject matter, specific language will be used with reference to the orientation illustrated in the Figures. It is to be understood that terms such as "upper", "lower", "above", and "below" are used for ease of convenience and description, and should be construed as limiting the disclosed subject matter.

With specific reference to FIG. 15, the first sidebar 630 and the rack pins 640 of the instant embodiment are configured slightly different from the previously-described sidebar 530 and rack pins 540. In the illustrated form, the true gates 643 and the interference member 633 have a non-rectangular cross-section, and more specifically a wedge-shaped cross-section. The true gate 643 is defined in part by an upper surface 686 and a lower surface 687. The interference member 633 is correspondingly-shaped and is defined, in part, by an upper surface 688 and a lower surface 689. The upper surfaces 686, 688 extend substantially entirely along the transverse direction, or substantially perpendicular to the lateral directions in which the rack pin 640 slides. In other words, the upper surfaces 686, 688 extend substantially perpendicular to the boundary plane 680. The lower surfaces 687, 689 are obliquely offset from the upper surfaces 686, 688, and extend in both the transverse and lateral directions. In other words, the lower surfaces 687, 689 extend toward the upper surfaces 686, 688 and the boundary plane 680 at an oblique angle.

As noted above, the previously-described interference member 533 and the true gates 543 are provided with rectangular cross-sections. In such forms, the interference member 533 and the true gates 543 may need to be manufactured within relatively tight tolerances. If the alignment of the interference member 533 and the true gate 543 is off even slightly when the key is inserted, the interference member upper surface 588 may be positioned above the true gate upper surface 586, or the interference member lower surface 589 may be positioned below the true gate lower surface 587. In either case, the interference member 533 will engage the contact surface 544, and the sidebar 530 will be blocked from moving radially inward beyond the intermediate position. In order to avoid this situation, each of the surfaces 586-589 are preferably formed with tight tolerances.

The wedge-shaped cross-sections of the instant embodiment may alleviate some of the above-described manufacturing difficulties. Specifically, in the instant embodiment, the sidebar 630 will be blocked from radially inward movement beyond the intermediate position if the interference member upper surface 688 is positioned above the true gate upper surface 686. However, if the interference member lower surface 689 is slightly misaligned with the true gate lower surface 687, the sidebar 630 may be able to move radially inward until the lower surfaces 687, 689 engage one another. When the lower surfaces 687, 689 engage one another, the rack pin 640 is urged into contact with the edge-cut bitting profile 694, thereby preventing further lateral travel of the rack pin 640.

If the misalignment between the lower surfaces 687, 689 is greater than a threshold amount, for example as a result of an unauthorized or improperly cut bitting profile 694, the sidebar 630 is blocked from moving to the inner position. As a result, the sidebar 630 continues to cross the shear line 601, and rotation of the plug 620 is prevented. If the misalignment between the lower surfaces 687, 689 is small, for example within manufacturing tolerances, the sidebar 630 may nonetheless be able to move to the inner position. Due to the fact that slight misalignment between the lower surfaces 687, 689 does not necessarily prevent the sidebar 630 from moving beyond the intermediate position, the lower surfaces 687, 689 may be formed with looser tolerances than the upper surfaces 686, 688 without adversely affecting the locking capabilities of the lock cylinder 600.

Figure 16:
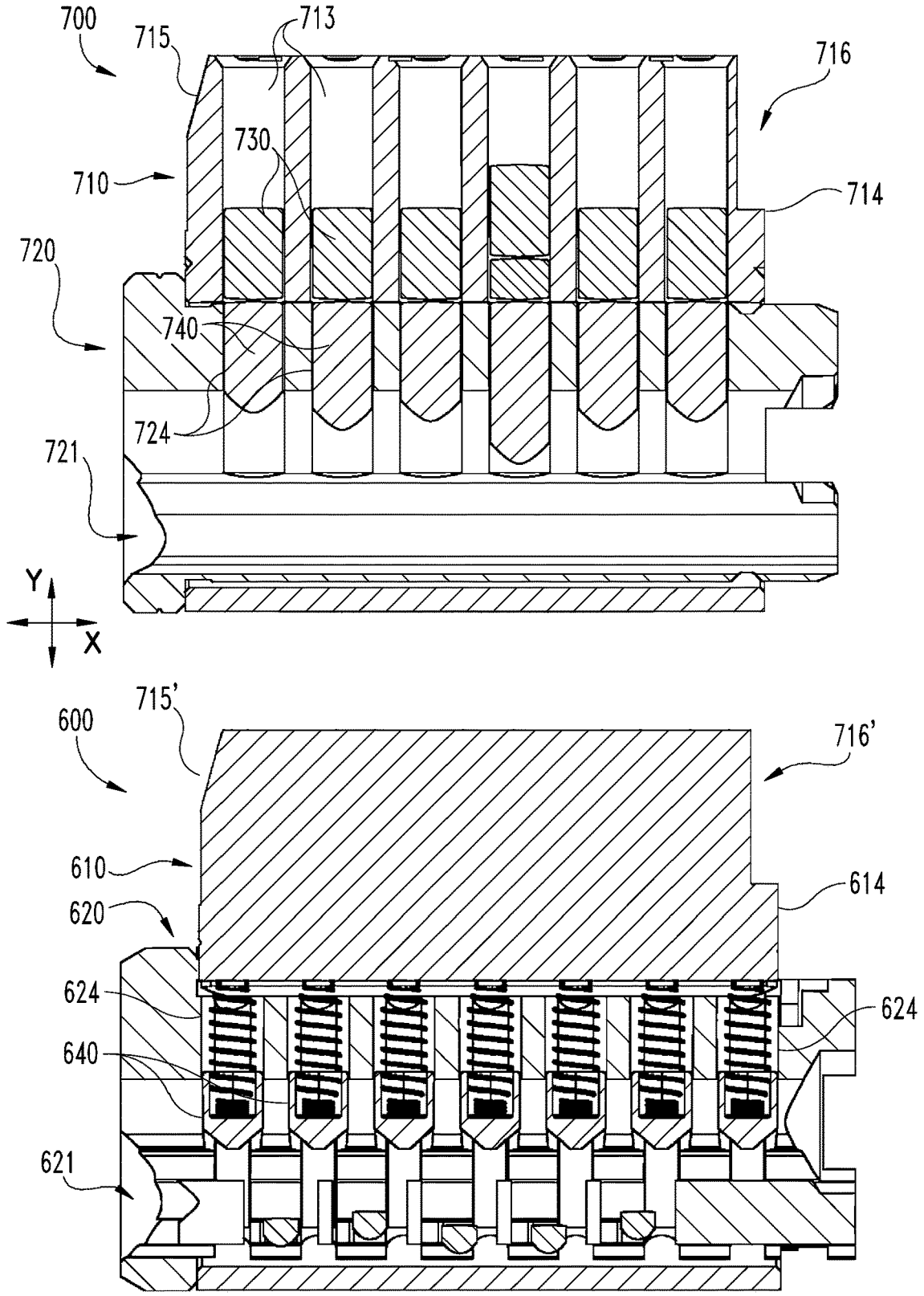
FIG. 16 illustrates cross-sectional views of a conventional lock cylinder and the lock cylinder depicted in FIG. 10.

With reference to FIG. 16, the lock cylinder 600 is illustrated along with a conventional lock cylinder 700. The conventional cylinder 700 includes a shell 710, a plug 720 rotatably seated in the shell 7110, and a pin tumbler system including a plurality of driving or top pins 730 and a plurality of driven or bottom pins 740. The lock cylinder 700 is of a standard six-pin format, and includes six of the top pins 730 and six of the bottom pins 740. The shell 710 is also of a standard six-pin format, and includes a tower 714 including six top pin chambers 713 which house the top pins 730. Similarly, the plug 720 is of a standard six-pin format, and includes six bottom pin chambers 724 which house the bottom pins 740.

Certain features and dimensions of the standard six-pin lock cylinder 700 are constrained by the various assemblies in which the lock cylinder 700 is used. For example, the tower 714 of a standard six-pin shell 710 is generally less than 1.25 inches in length, and may be in the range of one inch to 1.125 inches, between 0.75 inches and one inch, or between 0.875 inches and 1.125 inches. Additionally, the tower 714 of a standard format key-in-lever shell 710 commonly includes a tapered cutout 715 and/or a rectangular cutout 716. The length constraint and the cutout sections 715, 716 limit the amount of space available for the top pin chambers 713. As such, additional tumbler sets cannot be added to the standard six-pin cylinder 700 without decreasing the size of the pins 730, 740, which can in turn lead to decreased strength and other deleterious or negative effects.

In the illustrated lock cylinder 600, the exterior profile of the shell 610 is substantially similar to that of the standard shell 710, and may be identical thereto. In other words, the shell 610 may be of a standard six-pin format such that the cylinder 600 may be installed in assemblies designed to accept the standard cylinder 700. Due to the fact that the cylinder 600 does not require top pins in the tower 614, the top pin chambers may be omitted from the shell 610 in certain embodiments. In such embodiments, the shell 610 may nonetheless be considered to be of a standard six-pin format due to the fact that the shell 610 has the same exterior profile as the standard shell 710.

As noted above, the lock cylinder 600 does not require driving pins in the tower 614. As such, the rack pin cavities 624 need not align with top pin chambers in the tower 614. With the necessity for alignment obviated, a greater amount of longitudinal space within the plug 620 is available for the rack pin cavities 624. For example, the proximal-most rack pin cavity 624 may be aligned with the tapered cutout 715' of the tower 614, and the distal-most rack pin cavity 624 may be aligned with the rectangular cutout 716' in the tower 614. In certain forms, this additional space may enable the inclusion of a seventh rack pin 640 within a lock cylinder format which would otherwise allow for only six tumbler sets. As will be appreciated, the number of unique bitting codes available for a lock cylinder increases exponentially as additional bitting positions are added, thereby increasing the overall security of the lock.

In the illustrated embodiment, the lock cylinder 600 includes the shell 610 and a modular plug assembly 609 which includes the remaining elements of the lock cylinder 600. In certain embodiments, the shell 610 may be a dummy shell sized and configured for use in a standard lock cylinder format. Due to the fact that top pin chambers are not required in the shell 610, the tower 614 of the dummy shell 610 may be substantially solid. In other words, the top pin chambers need not be formed in the dummy shell 610, which may in turn reduce the cost of manufacturing. In other embodiments, the shell 610 may be omitted, and the plug assembly 609 may be manufactured and/or sold as a modular unit. In further embodiments, the plug assembly 609 may be manufactured and/or sold with a housing of another form.

Figure 17:
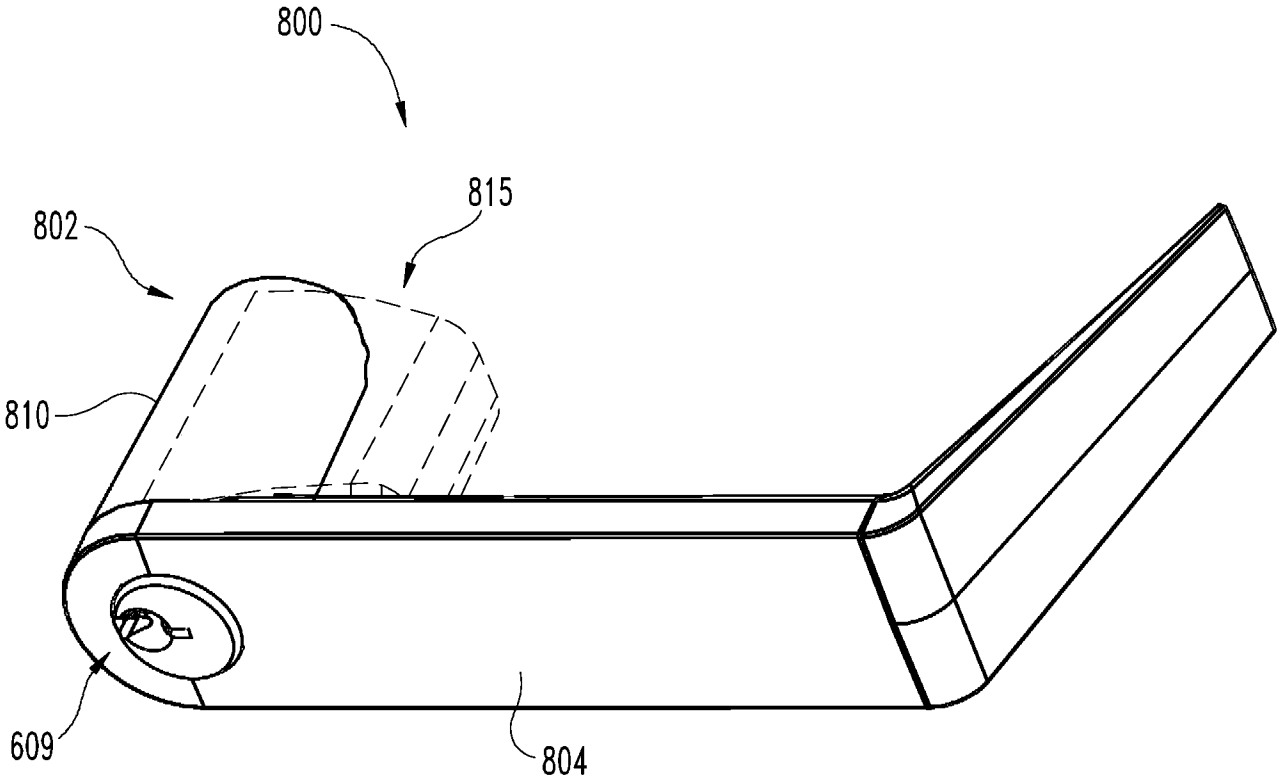
FIG. 17 is a perspective illustration of a handle assembly according to one embodiment.
Figure 18:
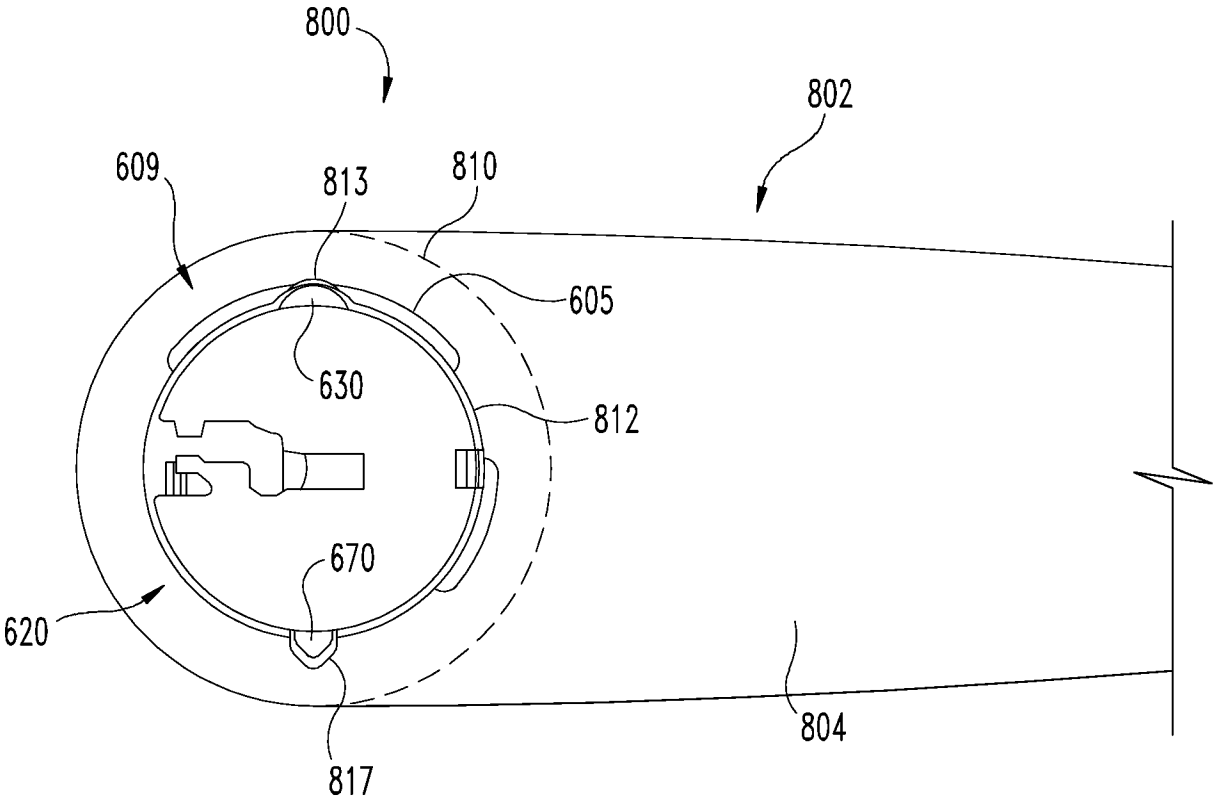
FIG. 18 is a cross-sectional illustration of the handle assembly depicted in FIG. 17.

With reference to FIGS. 17 and 18, a handle assembly 800 according to one embodiment includes a manual actuator in the form of a handle 802. The handle 802 includes a shank 810 and a lever 804 extending therefrom. The shank 810 includes a cylindrical chamber 812, a first longitudinal groove 813, and a second longitudinal groove 817, each of which are substantially similar to the corresponding elements described above with reference to the shell 610. In other words, the shank 810 replaces the shell 610, and acts as the housing for the plug assembly 609. The plug assembly 609 may be axially retained within the shank 810 by the clip 605.

Certain conventional handle assemblies have required that the shank 810 be provided with an extension 815 in order to accommodate the tower of the lock cylinder installed therein. However, due to the fact that the plug assembly 609 does not require a tower, the extension 815 may be omitted. In certain embodiments, the shank 810 may have a circular cross-section. Additionally, because the shank 810 need only accommodate the plug assembly 609, the greatest width of the shank 810 may be 0.75 inches or less in certain embodiments. In other embodiments, the greatest width of the shank 810 may be in the range of 0.5 inches to one inch, or 0.75 inches to 1.25 inches.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock plug assembly, comprising:

a plug body;

a plurality of rack pins positioned within openings in the plug body; and an arcuate cover plate rotatably coupled to the plug body and operable in a first angular position in which the rack pins are retained within the plug body and a second angular position in which the rack pins are removable from the plug body.

2. The lock plug assembly of claim 1, further comprising a sidebar movably coupled to the plug body, with a portion of the sidebar protruding beyond an outer surface of the plug body when the lock plug assembly is in a locked state.

3. The lock plug assembly of claim 2, wherein the sidebar is positioned within an axial channel defined by the plug body, the axial channel communicating with each of the openings in the plug body;

wherein the sidebar is free to move radially inward when an interference member formed on the sidebar is aligned with a receiving notch defined by each of the plurality of rack pins; and wherein the sidebar is not free to move radially inward when the interference member is not aligned with the receiving notch of at least one of the plurality of rack pins.

4. The lock plug assembly of claim 1, wherein the plug body is cylindrically-shaped and defines an outer radius corresponding to an inner radius of the arcuate cover plate.

5. The lock plug assembly of claim 1, wherein the arcuate cover plate is rotatable with respect to the plug body in an unlocked state of the lock plug assembly; and wherein the arcuate cover plate is not rotatable with respect to the plug body in a locked state of the lock plug assembly.

6. The lock plug assembly of claim 1, wherein the arcuate cover plate is snap fitted onto the plug body.

7. The lock plug assembly of claim 1, wherein the lock plug assembly is sized and shaped for axial insertion into and removal from a cylindrical chamber of an outer shell with the arcuate cover plate coupled to the plug body.

8. A lock plug assembly, comprising:

a plug body;

a plurality of rack pins positioned within openings in the plug body; and an arcuate cover plate rotatably coupled to the plug body and operable in a first angular position in which the rack pins are retained within the plug body and a second angular position in which the rack pins are removable from the plug body;

wherein one of the plug body and the arcuate cover plate includes a radial protrusion engagable with another of the plug body and the arcuate cover plate to resist rotation of the arcuate cover plate relative to the plug body.

9. The lock plug assembly of claim 8, wherein the radial protrusion is defined by the plug body, and wherein an edge of the arcuate cover plate is engaged with the radial protrusion to resist rotation of the arcuate cover plate relative to the plug body.

10. A lock plug assembly, comprising:

a plug body;

a plurality of rack pins positioned within openings in the plug body; and an arcuate cover plate rotatably coupled to the plug body and operable in a first angular position in which the rack pins are retained within the plug body and a second angular position in which the rack pins are removable from the plug body, wherein the arcuate cover plate extends along an arc having a central angle between 180° and 200°.

11. A lock plug assembly, comprising:

a plug body;

a plurality of rack pins positioned within openings in the plug body; and an arcuate cover plate rotatably coupled to the plug body and operable in a first angular position in which the rack pins are retained within the plug body and a second angular position in which the rack pins are removable from the plug body; and a plurality of rack pin biasing members, each positioned in one of the opening in the plug body between the arcuate cover plate and a corresponding one of the rack pins and configured to urge the corresponding one of the rack pins away from the arcuate cover plate.

12. A lock plug assembly, comprising:

a plug body having a circular shaped outer profile, the plug body comprising:

a keyway extending along a longitudinal axis of the plug body; and a plurality of openings communicating with the keyway;

a plurality of rack pins positioned in corresponding ones of the plurality of openings in the plug body; and an arcuate cover plate rotatably coupled to the plug body and operable to selectably expose and selectably cover at least a portion of each of the plurality of openings in the plug body while remaining rotatably coupled to the plug body.

13. The lock plug assembly of claim 12, wherein the plug body further comprises an axial channel formed on an outer surface of the plug body and communicating with each of the plurality of openings; and wherein the lock plug assembly further comprises a sidebar positioned within the axial channel of the plug body with a portion of the sidebar protruding beyond an outer surface of the plug body when the lock plug assembly is in a locked state.

14. The lock plug assembly of claim 13, wherein the sidebar is free to move radially inward when an interference member formed on the sidebar is aligned with a receiving notch defined by each of the plurality of rack pins; and wherein the sidebar is not free to move radially inward when the interference member is not aligned with the receiving notch of at least one of the plurality of rack pins.

15. The lock plug assembly of claim 12, wherein the arcuate cover plate is rotatable between an open position in which the plurality of rack pins are exposed, and a closed position in which the plurality of rack pins are covered by the arcuate cover plate.

16. The lock plug assembly of claim 12, wherein the plug body further comprising a ridge engagable with the arcuate cover plate to resist rotation of the arcuate cover plate relative to the plug body.

17. The lock plug assembly of claim 16, wherein an edge of the arcuate cover plate is engaged with the ridge to resist rotation of the arcuate cover plate relative to the plug body.

18. The lock plug assembly of claim 16, the arcuate cover plate defines a channel configured to receive the ridge when the arcuate cover plate is in an open position.

19. The lock plug assembly of claim 12, wherein the plug body is cylindrically-shaped and defines an outer radius corresponding to an inner radius of the arcuate cover plate.

20. The lock plug assembly of claim 12, wherein the arcuate cover plate extends along an arc having a central angle between 180° and 200°.

21. The lock plug assembly of claim 12, further comprising a plurality of rack pin biasing members, each positioned in one of the opening in the plug body between the arcuate cover plate and a corresponding one of the rack pins and configured to urge the corresponding one of the rack pins away from the arcuate cover plate.

22. A method of pinning a lock plug assembly including a plug body, a plurality of rack pins positionable in corresponding openings in the plug body, and an arcuate cover plate rotatably coupled to the plug body, the method comprising:

rotating the arcuate cover plate from a closed position in which the cover plate covers the openings in the plug body to an open position in which the openings in the plug body are exposed;

positioning each of the plurality of rack pins in the corresponding openings in the plug body when the arcuate cover plate is in the open position; and rotating the arcuate cover plate from the open position to the closed position, thereby covering the openings and maintaining the rack pins within the plug body.

23. The method of claim 22, further comprising inserting the lock plug assembly into a cylindrical chamber of an outer shell in an axial direction with the arcuate cover plate coupled to the plug body.

* * * * *